US010516943B2

(12) United States Patent
Dorfmeister et al.

(10) Patent No.: US 10,516,943 B2
(45) Date of Patent: Dec. 24, 2019

(54) MICROELECTROMECHANICAL DEVICE, AN ARRAY OF MICROELECTROMECHANICAL DEVICES, A METHOD OF MANUFACTURING A MICROELECTROMECHANICAL DEVICE, AND A METHOD OF OPERATING A MICROELECTROMECHANICAL DEVICE

(71) Applicant: Infineon Technologies AG, Neubiberg (DE)

(72) Inventors: Manuel Dorfmeister, Vienna (AT); Michael Schneider, Vienna (AT); Manfred Kaltenbacher, Vienna (AT); Alfons Dehe, Reutlingen (DE); Ursula Hedenig, Villach (AT); Thomas Grille, Villach (AT); Ulrich Schmid, Vienna (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 355 days.

(21) Appl. No.: 15/145,862

(22) Filed: May 4, 2016

(65) Prior Publication Data

US 2017/0325025 A1 Nov. 9, 2017

(51) Int. Cl.

| | |
|---|---|
| ***H04R 3/00*** | (2006.01) |
| ***H04R 3/06*** | (2006.01) |
| ***H04R 3/12*** | (2006.01) |
| ***H04R 17/00*** | (2006.01) |
| ***H04R 29/00*** | (2006.01) |
| ***H04R 31/00*** | (2006.01) |

(52) U.S. Cl.

CPC ..... *H04R 3/06* (2013.01); *H04R 3/12* (2013.01); *H04R 17/00* (2013.01); *H04R 29/001* (2013.01);

(Continued)

(58) Field of Classification Search

CPC ..... H01L 41/09; H04R 17/00; H04R 17/005; H04R 19/04; H04R 19/005;

(Continued)

(56) References Cited

U.S. PATENT DOCUMENTS

| | | | | |
|---|---|---|---|---|
| 9,212,045 | B1 | 12/2015 | Schmid et al. | |
| 2008/0025545 | A1 * | 1/2008 | Carr | H04R 1/406 381/357 |

(Continued)

FOREIGN PATENT DOCUMENTS

| | | | |
|---|---|---|---|
| CN | 2035682456 | U | 5/2014 |
| DE | 19637928 | A1 | 8/1997 |

(Continued)

OTHER PUBLICATIONS

Sanchez-Rojas et al., "Modal optimization and filtering in piezoelectric microplate resonators", Journal of Micromechanics and Microengineering, 2010, 8 pages, vol. 20, IOP Publishing Ltd.

(Continued)

*Primary Examiner* — Matthew A Eason

(74) *Attorney, Agent, or Firm* — Viering, Jentschura & Partner MBB

(57) ABSTRACT

Aspects of a microelectromechanical device, an array of microelectromechanical devices, a method of manufacturing a microelectromechanical device, and a method of operating a microelectromechanical device, are discussed herein. The microelectromechanical device may include: a substrate; a diaphragm mechanically coupled to the substrate, the diaphragm comprising a stressed region to buckle the diaphragm into one of two geometrically stable positions; an actuator mechanically coupled to the diaphragm, the actuator comprising a piezoelectric layer over the diaphragm; a controller configured to provide an electrical control signal in response to a digital sound input; wherein the actuator is (Continued)

configured to receive the electrical control signal to exert a mechanical piezoelectric force on the diaphragm via the piezoelectric layer to move the diaphragm to create a sound wave.

24 Claims, 11 Drawing Sheets

(52) U.S. Cl.
CPC ..... *H04R 31/00* (2013.01); *H04R 2201/003* (2013.01); *H04R 2307/025* (2013.01)

(58) Field of Classification Search
CPC ..... H04R 2201/003; H04R 31/00; H04R 2307/023; H04R 2307/025; H04R 3/06; H04R 3/12; H04R 29/001
USPC ..... 381/190
See application file for complete search history.

(56) References Cited

U.S. PATENT DOCUMENTS

2012/0177211 A1* 7/2012 Yamkovoy ..... G01D 5/2417 381/59
2013/0008769 A1 1/2013 Baugher
2013/0062710 A1 3/2013 Dehe
2013/0294636 A1* 11/2013 Cassett ..... H04R 1/02 381/386
2014/0007682 A1* 1/2014 Kabasawa ..... G01C 19/56 73/504.12
2014/0177881 A1* 6/2014 Fanget ..... H04R 3/002 381/190
2014/0230546 A1 8/2014 Allegato et al.
2015/0071467 A1* 3/2015 Kaplan ..... H04R 17/00 381/190
2016/0240768 A1 8/2016 Fujii et al.

FOREIGN PATENT DOCUMENTS

EP 1428661 A2 6/2004
JP 2015088521 A 5/2015
KR 10-2013-0028880 A 3/2013

OTHER PUBLICATIONS

Chinese Office Action based on Application No. 20170307929.2 dated Apr. 16, 2019 and Chinese Search Report based on Application No. 20170307929.2 dated Apr. 3, 2019 (8 pages) (for reference purpose only).

* cited by examiner

MICROELECTROMECHANICAL DEVICE, AN ARRAY OF MICROELECTROMECHANICAL DEVICES, A METHOD OF MANUFACTURING A MICROELECTROMECHANICAL DEVICE, AND A METHOD OF OPERATING A MICROELECTROMECHANICAL DEVICE

TECHNICAL FIELD

Various embodiments relate generally to a microelectromechanical device, an array of microelectromechanical devices, a method of manufacturing a microelectromechanical device, and a method of operating a microelectromechanical device.

BACKGROUND

A microelectromechanical system (MEMS) may be produced for use as a loudspeaker or for other appropriate utilizations. The MEMS loudspeaker may have a diaphragm that is actuated to create a sound wave. If the diaphragm is pre-stressed to have a bistable geometry, the "buckling" effect may be exploited to enhance the MEMS device, e.g., transfer from one stable position to a second stable position with a high acceleration may be more energy efficient for sound wave generation. However, depending on the diaphragm geometry, transfer between the stable positions may have an equal amplitude in both directions which may, e.g., negatively affect a generated sound wave. Accordingly, effective control of the bistable diaphragm would be beneficial. Thus, creation of a sound wave from the high acceleration of the diaphragm may be used in an array to allow for digital sound reconstruction.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1A:
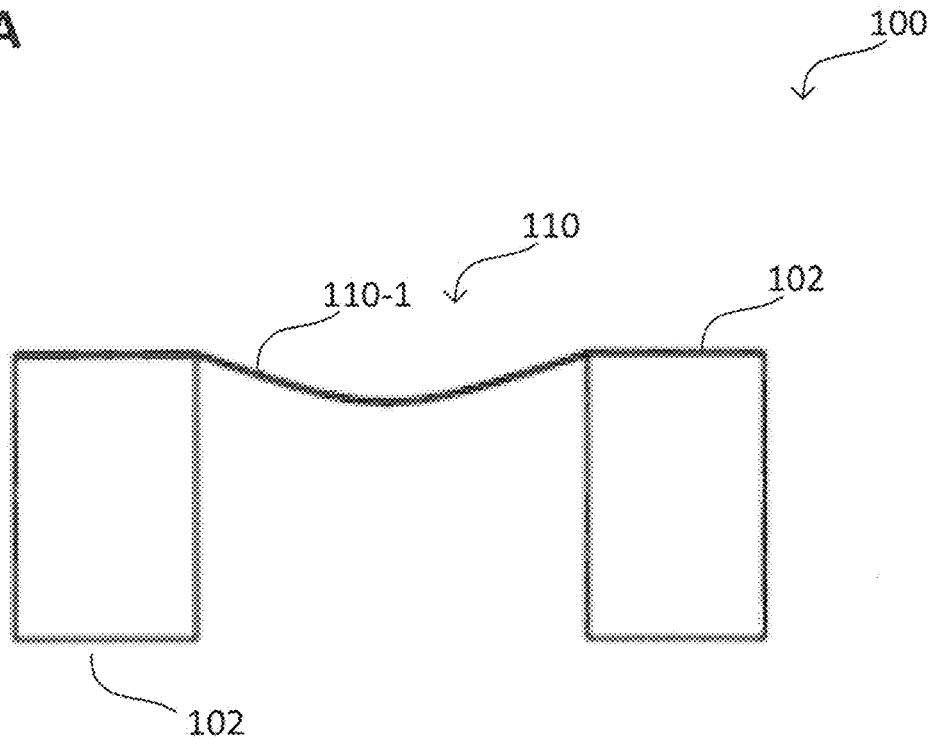
FIGS. 1A & 1B show a microelectromechanical device with a bistable diaphragm.

The following detailed description refers to the accompanying drawings that show, by way of illustration, specific details and embodiments in which the invention may be practiced. In the following drawings, similar or the same elements may have similar or the same reference numerals (e.g., diaphragm 110). A description of the element may, in the interests of brevity, be omitted in subsequent descriptions.

The word "exemplary" is used herein to mean, "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g., in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

As used herein, a "circuit" may be understood as any kind of logic (analog or digital) implementing entity, which may be special purpose circuitry or a processor executing software stored in a memory, firmware, hardware, or any combination thereof. Furthermore, a "circuit" may be a hard-wired logic circuit or a programmable logic circuit such as a programmable processor, for example a microprocessor (for example a Complex Instruction Set Computer (CISC) processor or a Reduced Instruction Set Computer (RISC) processor). A "circuit" may also be a processor executing software, for example any kind of computer program, for example a non-transitory computer readable medium, for example a computer program using a virtual machine code such as, for example, Java. Any other kind of implementation of the respective functions which will be described in more detail below may also be understood as a "circuit". It is understood that any two (or more) of the described circuits may be combined into a single circuit with substantially equivalent functionality, and, conversely, that any single described circuit may be distributed into two (or more) separate circuits with substantially equivalent functionality. In particular with respect to the use of "circuitry" in the Claims included herein, the use of "circuit" may be understood as collectively referring to two or more circuits.

The term "forming" may refer to disposing, arranging, structuring, or depositing. A method for forming, e.g., a layer, a material, or a region, etc., may include various deposition methods which, inter alia, may include: chemical vapor deposition, physical vapor deposition (e.g., for dielectric materials), electrodeposition (which may also be referred to as electroplating, e.g., for metals or metal alloys), or spin coating (e.g., for fluid materials). Generally, a vapor deposition may be performed by sputtering, laser ablation, cathodic arc vaporization, or thermal evaporation. A method for forming metals may include metal plating, e.g., electroplating or chemical plating.

The term "forming" may also include a chemical reaction or fabrication of a chemical composition, where, for example, at least a portion of the layer, the material, or the region is formed by a transformation of one set of chemical substances into the chemical composition. "Forming" may, for example, include: changing the positions of electrons by breaking or forming chemical bonds between atoms of the set of chemical substances. The term "forming" may further include oxidation and reduction, complexation, precipitation, acid-base reaction, solid-state reaction, substitution, doping, addition and elimination, diffusion, or a photochemical reaction. "Forming" may, for example, change the chemical and physical properties of the set of chemical substances which chemically compose a portion of the layer, material, or region. Exemplary chemical properties or physical properties may include electrical conductivity, phase composition, or optical properties, etc. "Forming" may, e.g., include the application of a chemical reagent to an initial compound to change the chemical and physical properties of the initial compound.

The term "structuring" may refer to modifying the form of a structure (e.g., modifying the structure to achieve a desired shape or a desired pattern). To structure, e.g., a material, a portion of the material may be removed, e.g., via etching. To remove material from, for example a layer, material, or region, a mask (that provides a pattern) may be used, i.e., the mask provides a pattern for removing material (e.g., etching a structure to remove material of the structure) according to the pattern of the mask. Illustratively, the mask may prevent regions (which may be intended to remain) from being removed (e.g., by etching). Alternatively or additionally, to structure the layer, the material or the region of material may be disposed using a mask (the mask providing a pattern). The mask may provide a pattern for forming (e.g., disposing) material in accordance with the pattern of the mask.

In general, removing material may include a process such as etching of the material. The term "etching" may include various etching procedures, e.g., chemical etching (including, for example, wet etching or dry etching), physical etching, plasma etching, ion etching, etc. In etching a layer, a material, or a region, an etchant may be applied to the layer, the material, or the region. For example, the etchant may react with the layer, the material, or the region, forming a substance (or chemical compound) which may be easily removed, e.g., a volatile substance. Alternatively or additionally, the etchant may, for example, vaporize the layer, the material, or the region.

The mask may be a temporary mask, i.e., it may be removed after etching (e.g., the mask may be formed from a resin or a metal or another material such as a hard mask material such as silicon oxide, silicon nitride or carbon, etc.) or the mask may be a permanent mask (e.g., a mask-blade), which may be used several times. A temporary mask may be formed, e.g., using a photomask.

According to various embodiments, a microelectromechanical device may be formed as part of, or may include, a semiconductor chip. For example, the semiconductor chip may include the microelectromechanical device (which may also be referred to as a microelectromechanical component). In other words, the microelectromechanical device may be implemented into (e.g., may be part of) a semiconductor chip, e.g., monolithically integrated. The semiconductor chip (which may also be referred to as a chip, die, or microchip) may be processed in semiconductor technologies, on a wafer, or in a wafer (or, e.g., a substrate or a carrier). The semiconductor chip may include one or more microelectromechanical devices (MEMS), which are formed during semiconductor technology processing or fabrication. The semiconductor substrate may be part of the semiconductor chip, e.g., the semiconductor substrate may be part of, or may form, the semiconductor body of the chip. Optionally, the microelectromechanical component may be part of, or may be electrically coupled to, an integrated circuit on the chip.

According to various embodiments, a semiconductor substrate (e.g., of a microelectromechanical device, e.g., the semiconductor substrate of a semiconductor chip) may be singulated from a wafer by removing material from a kerf region of the wafer (also referred to as dicing or cutting the wafer). For example, removing material from the kerf region of the wafer may be processed by scribing and breaking, cleavage, blade dicing, or mechanical sawing (e.g., using a dicing saw). In other words, the semiconductor substrate may be singulated by a wafer dicing process. After the wafer dicing process, the semiconductor substrate (or the finished microelectromechanical device) may be electrically contacted and encapsulated, e.g., by mold materials, into a chip carrier (which may also be referred to as a chip housing) which may then be suitable for use in electronic devices, such as gauges. For example, the semiconductor chip may be bonded to a chip carrier by wires. Furthermore, the semiconductor chip (which may be bonded to a chip carrier) may be mounted (e.g., soldered) onto a printed circuit board.

According to various embodiments, a semiconductor substrate (e.g., of a microelectromechanical device or the semiconductor substrate of a semiconductor chip) may include or may be made of (in other words, formed from) semiconductor materials of various types, including a group IV semiconductor (e.g., silicon or germanium), a compound semiconductor, e.g., a group III-V compound semiconductor (e.g., gallium arsenide), or other types, including group III semiconductors, group V semiconductors, or polymers, for example. In an embodiment, the semiconductor substrate may be made of silicon (doped or undoped). In an alternative embodiment, the semiconductor substrate may be a silicon on insulator (SOI) wafer. As an alternative, any other suitable semiconductor material may be used for the semiconductor substrate, for example, semiconductor compound material such as gallium phosphide (GaP), indium phosphide (InP), or any suitable ternary semiconductor compound material, such as indium gallium arsenide (InGaAs), or quaternary semiconductor compound material, such as aluminum gallium indium phosphide (AlInGaP).

According to various embodiments, a semiconductor substrate (e.g., of a microelectromechanical device or the semiconductor substrate of a semiconductor chip) may be covered with a passivation layer for protecting the semiconductor substrate from environmental influence, e.g., oxidation. The passivation layer may include a metal oxide, an oxide of the semiconductor substrate (which may also be referred to as a substrate or semiconductor body), e.g., silicon oxide, a nitride, e.g., silicon nitride, a polymer, e.g., benzocyclobutene (BCB) or polyimide (PI), a resin, a resist, or a dielectric material.

According to various embodiments, an electrically conductive material may include or may be formed from: a metal, a metal alloy, an intermetallic compound, a silicide (e.g., titanium silicide, molybdenum silicide, tantalum silicide, or tungsten silicide), a conductive polymer, a polycrystalline semiconductor, or a highly doped semiconductor, e.g., polycrystalline silicon (which may also be referred to as polysilicon), or a highly doped silicon. An electrically conductive material may be understood as material with moderate electrical conductivity, e.g., with an electrical conductivity (measured at room temperature and constant electric field direction) greater than about 10 S/m, e.g., greater than about $10^2$ S/m, or with high electrical conductivity, e.g., greater than about $10^4$ S/m, e.g., greater than about $10^6$ S/m.

According to various embodiments, a metal may include or may be formed from one element of the following group of elements: aluminum, copper, nickel, magnesium, chromium, iron, zinc, tin, gold, silver, iridium, platinum, or titanium. Alternatively or additionally, a metal may include or may be formed from a metal alloy including one element or more than one element. For example, a metal alloy may include an intermetallic compound, e.g., an intermetallic compound of gold and aluminum, an intermetallic compound of copper and aluminum, an intermetallic compound of copper and zinc (brass) or an intermetallic compound of copper and tin (bronze).

According to various embodiments, a dielectric material, e.g., an electrically insulating material, may be understood as material with poor electrical conductivity, e.g., with an electrical conductivity (measured at room temperature and constant electric field direction) less than about $10^{-2}$ S/m, e.g., less than about $10^{-5}$ S/m, or, e.g., less than about $10^{-7}$ S/m.

According to various embodiments, a dielectric material may include a semiconductor oxide, a metal oxide, a ceramic, a semiconductor nitride, a metal nitride, a semiconductor carbide, a metal carbide, a glass, e.g., fluorosilicate glass (FSG), a dielectric polymer, a silicate, e.g., hafnium silicate or zirconium silicate, a transition metal oxide, e.g., hafnium dioxide or zirconium dioxide, an oxynitride, e.g., silicon oxynitride, or any other type of dielectric material. A dielectric material may withstand an electric field without breaking down (in other words without experiencing failure of its insulating properties, e.g., without substantially changing its electrical conductivity).

According to various embodiments, a microelectromechanical device may be configured to receive a digital sound input at a controller and provide an electrical control signal to an actuator from the controller to exert a mechanical piezoelectric force on the diaphragm via the piezoelectric layer to move the diaphragm to create a sound wave. In general, a microelectromechanical device may be configured to transfer mechanical energy into electrical energy and/or electrical energy into mechanical energy. In other words, a microelectromechanical component may function as a transducer that is configured to convert mechanical energy into electrical energy or vice versa. A microelectromechanical device may have a size (e.g., a diameter or a lateral width) in the range from about a few micrometers (μm) to about a few millimeters (mm), e.g., in the range from about 10 μm to about 5 mm, e.g., in the range from about 100 μm to about 2 mm, e.g., about 1 mm, e.g., in the range of 0.5 mm to 1.5 mm, or, alternatively, smaller than about 1 mm, e.g., smaller than 500 μm, e.g., smaller than 100 μm. A microelectromechanical device according to various embodiments may be processed in semiconductor technology.

A microelectromechanical device according to various embodiments may be used as a sensor (e.g., a micro-sensor) for sensing a mechanical signal and to generate an electrical signal which represents the mechanical signal. Alternatively, a microelectromechanical component may be used as an actuator for generating a mechanical signal based on the electrical signal. For example, the microelectromechanical device may be used as microphone or as a speaker (loudspeaker).

The microelectromechanical device may include a diaphragm. The diaphragm may be configured to actuate in response to a force. The force may be provided externally from the microelectromechanical device, i.e., the force may not originate from the microelectromechanical device. The force may be a mechanical interaction, i.e., a pressure-gradient, e.g., a mechanical wave (including acoustic waves or sound waves), pressure, such as gauge pressure. Additionally or alternatively, the force may be an electric field interaction, i.e., a Coulomb force or an electrostatic force, or may be a magnetic field interaction, e.g., magnetic force, such as Lorentz force, etc. An electrically-conductive component, e.g., an electrode or a sensor, may provide an electrical signal in response to the actuation of the diaphragm. The electrical signal may represent the force on the diaphragm or the actuation of the diaphragm (e.g., or the electrical signal may be proportional to the force).

Additionally or alternatively, the force to actuate the diaphragm may be provided by the microelectromechanical device, i.e., the force may originate from an element of the microelectromechanical device. For example, the force may be provided by an electrically-conductive component, e.g., an electrode that is part of the microelectromechanical device or an actuator including a piezoelectric element. The electrically-conductive component may provide a force to actuate the diaphragm in response to an electrical signal transmitted to the electrically-conductive component. The electrical signal may be transmitted by an electronic circuit, e.g., a controller or a processor. The electrically-conductive component may exert a force on the diaphragm by an electric field interaction, a magnetic field interaction, or a combination thereof.

Piezoelectric materials, such as aluminum nitride, zinc oxide, and lead zirconate titanate, are characterized by a coupling of a voltage state and a polarization of the material. An applied pressure deforms a unit cell in the crystalline structure of the piezoelectric material which creates a charge displacement that polarizes the material. This is known as the piezoelectric effect. The inverse piezoelectric effect works on the opposite principle, i.e., application of an electric field results in a deformation of the crystalline structure of the piezoelectric material.

FIG. 1A shows a microelectromechanical device 100 with a bistable diaphragm 110. The diaphragm 110 may be mechanically coupled to substrate 102. Diagram 100A may show diaphragm 110 in a geometrically stable position 1101. Due to the "buckling" effect, e.g., a defined, mechanical pre-stressing of diaphragm 110, diaphragm 110 may be in a stable geometric-equilibrium position at position 1101, i.e., energy input is not necessary to hold diaphragm 110 in stable position 110-1.

Substrate 102 of microelectromechanical device 100 may be formed from a semiconductor, e.g. silicon. The silicon may be a monocrystalline silicon or a polycrystalline silicon. Additionally or alternatively, the semiconductor may be a silicon-compound, e.g., amorphous silicon carbide or polycrystalline silicon carbide.

Diaphragm 110 may also be formed from a semiconductor material, which may allow for a high mechanical stability, e.g., the same material as substrate 102 or a different material as substrate 102. Diaphragm 110 may be formed from silicon or a silicon compound, e.g., monocrystalline silicon, polycrystalline silicon, silicon nitride, amorphous silicon carbide, or polycrystalline silicon carbide.

Figure 1B:
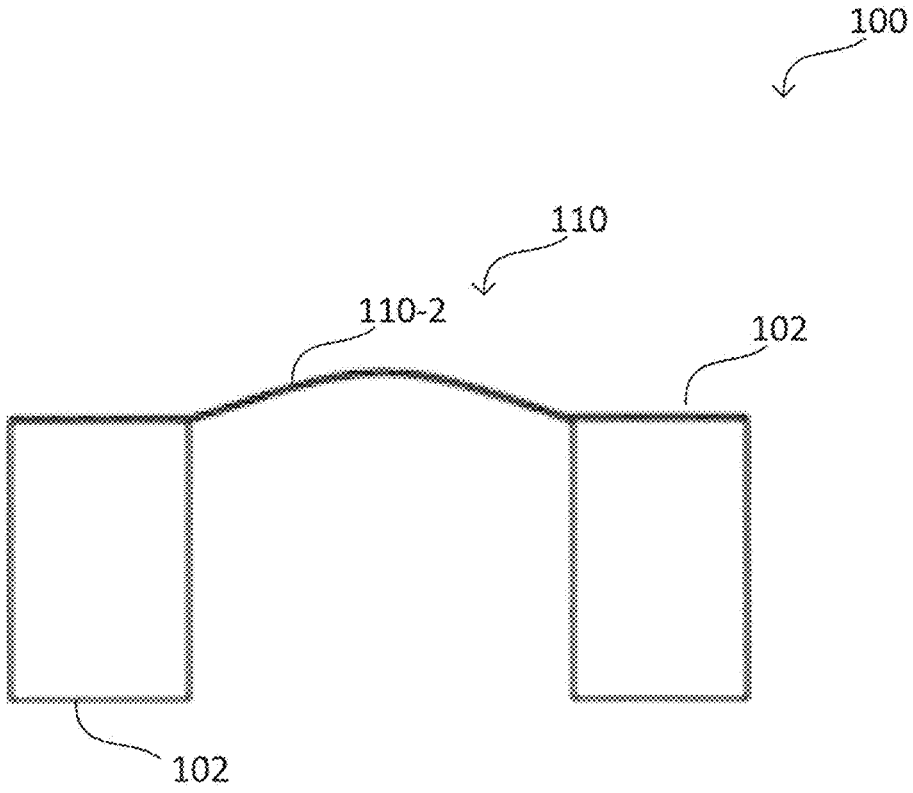

FIG. 1B shows microelectromechanical device 100 with bistable diaphragm 110. Here, diaphragm 110 may be in another geometrically stable position 110-2 (in reference to geometrically stable position 110-1 in FIG. 1A), i.e., position 110-2 may be one of two stable geometric-equilibrium positions of diaphragm 110. Transfer between the two stable positions, e.g., moving from 110-1 to 110-2, may be achieved by overcoming a diaphragm-specific stress value of diaphragm 110, e.g., a critical load or force due to any one or a combination of the geometry, material, suspension or coupling, etc.

FIG. 2A-2G show various aspects of exemplary bistable diaphragms 110. A bistable diaphragm may not be restricted to special geometries. The diaphragm may be square, cross-shaped, or circular, etc. A number of examples may impart the "buckling" effect in a mechanically pre-stressed diaphragm 110. For example, an additional thin-layer technique with a defined layer-stress may be formed over diaphragm 110. The pre-stressed layer may be an additional layer formed over diaphragm 110 solely to impart the stress, or may be a pre-stressed layer of another structure formed over diaphragm 110. Additionally or alternatively, diaphragm 110 may be pre-stressed by achieving a desired tension in the structure of diaphragm 110 by the surrounding package, e.g., stressing substrate 102. Additionally or alternatively, diaphragm 110 may pre-stressed, e.g., by implantation or doping via a structural dopant in diaphragm 110 that introduces a defined compressive stress gradient.

As may be used herein, a structural dopant may refer to a dopant that intentionally alters physical or mechanical properties of the diaphragm as opposed to a dopant that alters electrical properties of the diaphragm, e.g., to increase conductivity of the diaphragm or a region of the diaphragm. A structural dopant, e.g., carbon, may be implanted to form a pre-stressed region of a diaphragm to create a stressed, geometrically bistable diaphragm, but does not significantly alter electrical properties of the diaphragm. Note, however, that a stressed region must not exclusively include a structural dopant, i.e., a stressed region may denote a region where structural dopants have been implanted, however, a conductively doped region may overlap a stressed region, e.g., a dopant that may increase conductivity of a region of the diaphragm may also be deposited in or over the stressed region.

Thus, a region, where stress is imparted to diaphragm 110 for the "buckling" effect, may be imparted, or defined, over an entire surface of diaphragm 110 or part of diaphragm 110. Various aspects or examples may be discussed below in reference to FIG. 2A-2G.

Figure 2A:
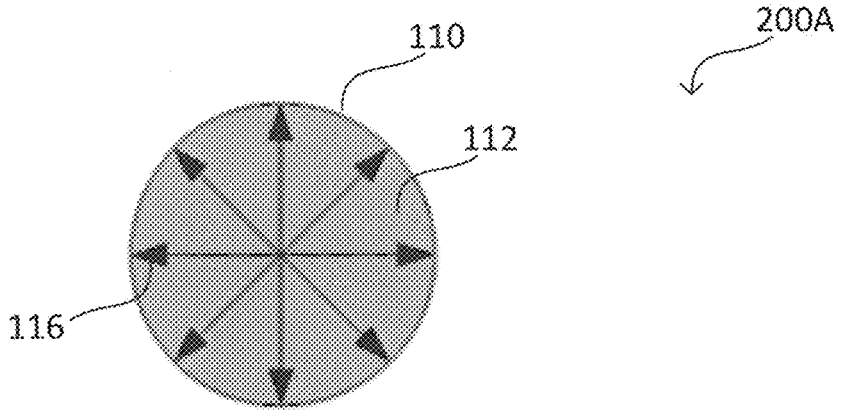
FIG. 2A-2G show various aspects of a bistable diaphragm.

For example, diaphragm 110 may have a circular form as may be seen in top view 200A of FIG. 2A. Stressed region 112 may cover an entire surface, e.g., a top surface, of diaphragm 110. Arrows 116 may indicate stress imparted to diaphragm 110.

Figure 2B:
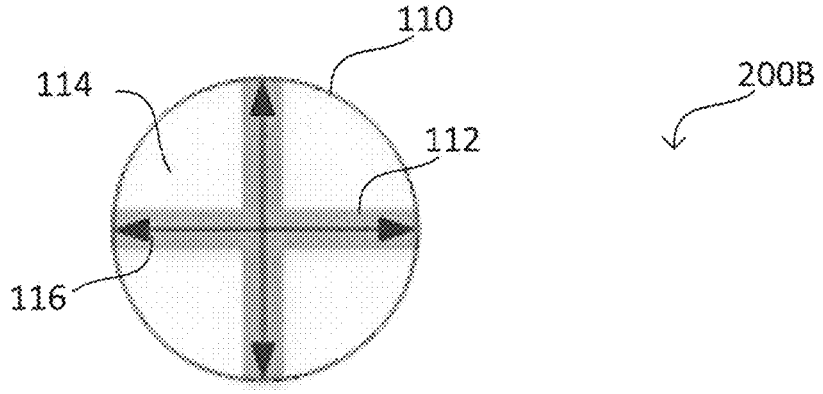

As may be seen in FIG. 2B, top view 200B shows diaphragm 110 in a circular form. Stressed region 112 may partially cover a surface of the circular form of diaphragm 110. Stressed region 112 may be formed along at least one diameter of diaphragm 110, e.g., two diameters, which may be perpendicular to each other. Thus, region 114 of diaphragm 110 may not be directly stressed, i.e., region 114 may experience stress or a stress gradient, but, for example, a pre-stressed layer may not be applied over region 114 or a structural dopant may not be implanted in region 114. Arrows 116 may indicate stress imparted to diaphragm 110.

Figure 2C:
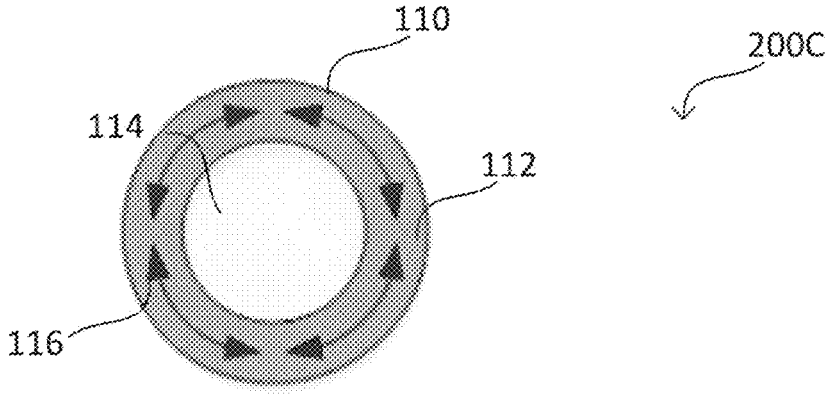

FIG. 2C may also show a top view 200C of diaphragm 110 with a circular form. However, stressed region 112 may be formed along a circumference of the circular form, i.e., may partially cover a surface of the circular form so that region 114 may not be directly stressed. Stressed region 112 may extend a substantially uniform predefined distance from the circumference of the circular form of diaphragm 110. Arrows 116 may indicate stress imparted to diaphragm 110.

Figure 2D:
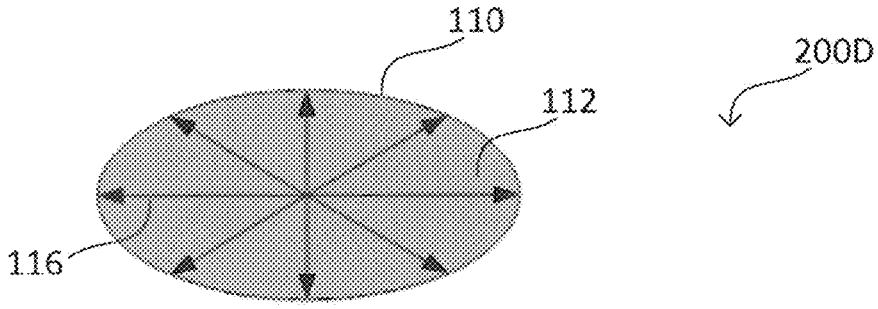

A diaphragm 110 with an elliptical form may be shown in a top view 200D of FIG. 2D. Stressed region 112 may cover an entire surface of the elliptical form. Arrows 116 may indicate stress imparted to diaphragm 110. In an alternative to FIG. 2A-2D above, diaphragm 110 may have a polygonal form.

Figure 2E:
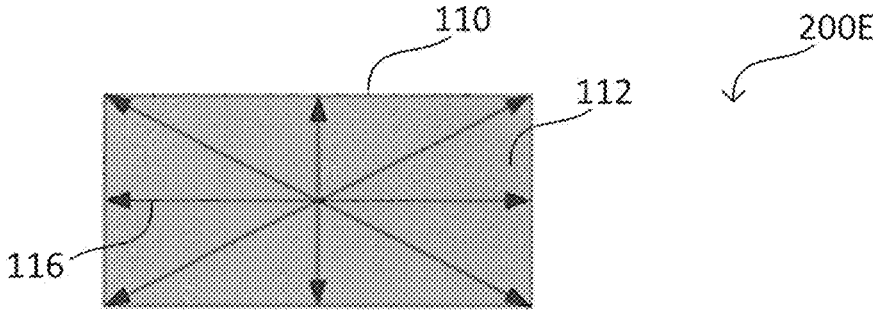

For example, top view 200E of FIG. 2E may show a diaphragm 110 with a rectangular form. Stressed region 112 may cover an entire surface of the rectangular form. Arrows 116 may indicate stress imparted to diaphragm 110.

Figure 2F:
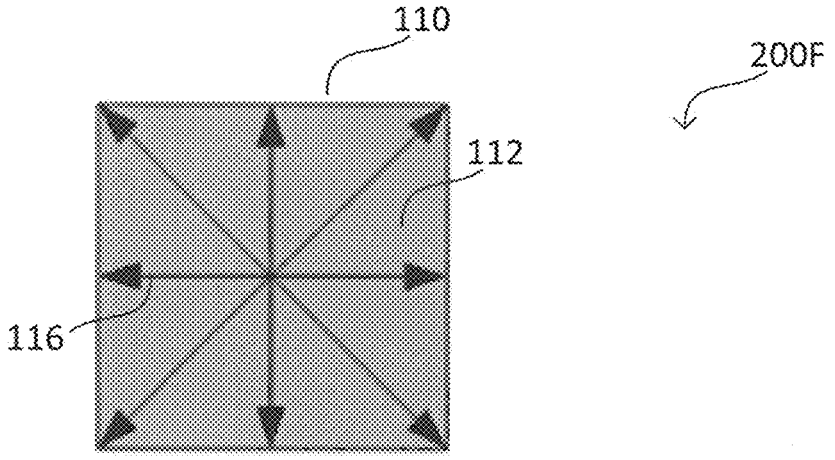

FIG. 2F may show a square form of diaphragm 110 in a top view 200F. As may be seen here, stressed region 112 may cover an entire surface of the square form of diaphragm 110. Arrows 116 may indicate stress imparted to diaphragm 110.

Figure 2G:
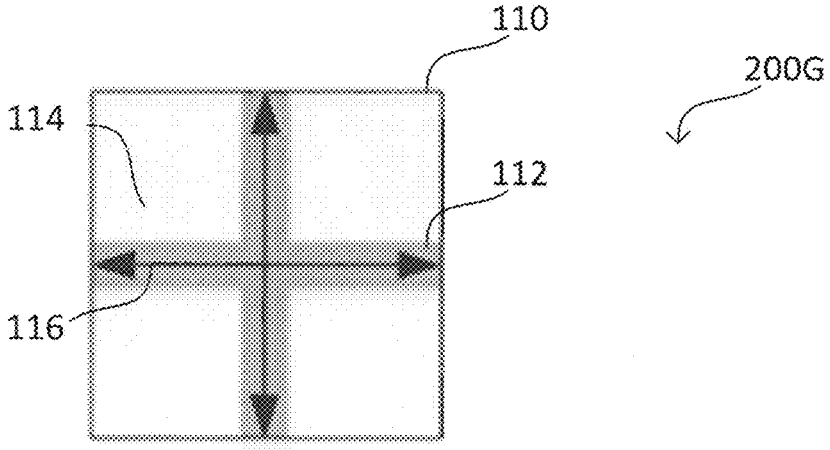

However, a surface of the square form of diaphragm 110 in top view 200G of FIG. 2G may be partially covered by stressed region 112. Region 114 may not be directly stressed. The stressed region 112 may be formed along two bisectors of the square form, e.g., side bisectors as may be seen in FIG. 2G or, for example, angular bisectors. Arrows 116 may indicate stress imparted to diaphragm 110.

Figure 3A:
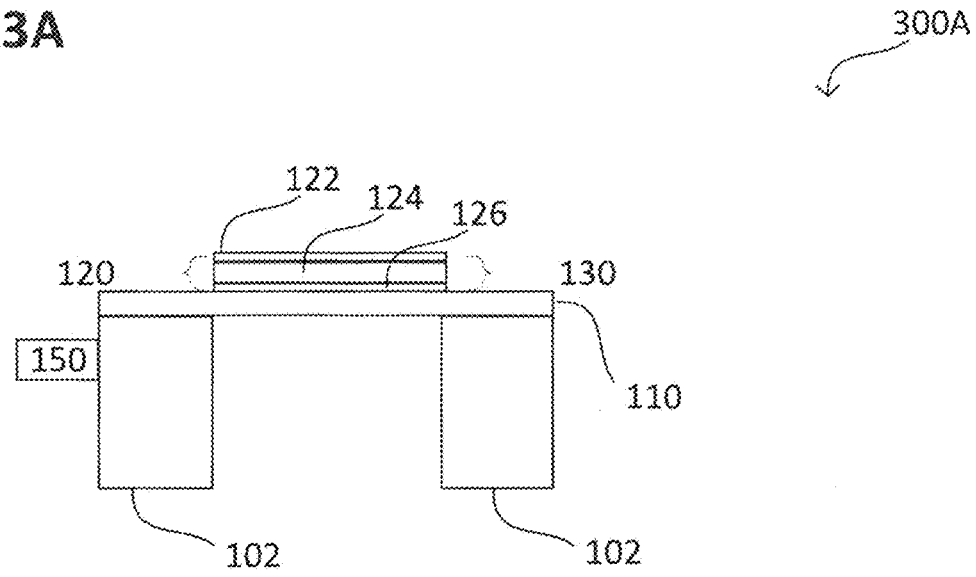
FIG. 3A-3C show a microelectromechanical device.

FIG. 3A may show microelectromechanical device 300A. Microelectromechanical device 300A may include: a substrate 102; a diaphragm 110 mechanically coupled to the substrate 102; the diaphragm 110 may include a stressed region to buckle the diaphragm into one of two geometrically stable positions (for convenience, exemplary positions 110-1 and 110-2 of bistable diaphragm 110 are not shown here); an actuator 120 mechanically coupled to the diaphragm 110, the actuator 120 including a piezoelectric layer 124 over the diaphragm 110 (actuator 120 may, e.g., also include first electrode 122 and second electrode 126, as shown here); a controller 150 configured to provide an electrical control signal in response to a digital sound input; wherein the actuator 120 is configured to receive the electrical control signal to exert a mechanical piezoelectric force on the diaphragm 110 via the piezoelectric layer 124 to move the diaphragm 110 to create a sound wave. Controller 150 may be coupled to actuator 120.

Piezoelectric layer 124 of actuator 120 may include zinc oxide (ZnO). Piezoelectric layer 124 may include lead zirconate titanate (PZT), which may have a reduced compatibility with integration in CMOS (complimentary metal-oxide-semiconductor) processes, however, may produce a high actuator potential. Piezoelectric layer 124 may include aluminum nitride (AlN).

Actuator 120 may include first electrode 122 mechanically coupled to a top surface of the piezoelectric layer 124. First electrode 122 may include an electrically conductive material such as metal, e.g., aluminum, gold, and platinum. Actuator 120 may further include a second electrode 126 mechanically coupled to a bottom surface of the piezoelectric layer 124 over the diaphragm 110. Second electrode 126 may be formed from typical actuator or donor materials to create an electrically conductive region, such as a metallic thin-film or directly through a semiconductor material, e.g., a doped semiconductor material, as an additional layer or as part of diaphragm 110. Second electrode 126 may include an electrically conductive material. Second electrode 126 may include a metal, such as aluminum, gold, and platinum. Additionally or alternatively, diaphragm 110 may include a conductive region configured as a second electrode 126 coupled to a bottom surface of the piezoelectric layer 124. The second electrode may include a semiconductor material, e.g., a doped semiconductor.

Microelectromechanical device 300 may further include sensor 130 coupled to the diaphragm. Sensor 130 may additionally be coupled to a circuit configured to convert an analog input into a digital output, e.g., to receive an input from sensor 130 and provide a signal corresponding to the input. The circuit may be the same or different from controller 150. Sensor 130 may be configured to determine a position of the diaphragm 110 between the two geometrically stable positions. As may be seen in FIG. 3A, piezoelectric layer 124 of the actuator 120 may be further configured as a sensor 130 to determine a position of the diaphragm 110 between the two geometrically stable positions. As may be seen in FIG. 3B, sensor 130 may include a further piezoelectric layer mechanically coupled to the diaphragm 110. The further piezoelectric layer may be coupled to a surface of diaphragm 110 and may not be limited to the configuration shown in FIG. 3B. The further piezoelectric layer may include AN. The further piezoelectric layer may include ZnO. The further piezoelectric layer may include PZT. As may be seen in FIG. 3C, the sensor 130 may include an electrode capacitively coupled to the diaphragm 110. The electrode may include an electrically conductive material, such as metal. For example, the electrode may include at least one of aluminum, gold, and platinum. The electrode in sensor 130 may have holes or perforations to allow a medium surrounding diaphragm 110 to pass through.

As discussed above, diaphragm 110 may be composed of silicon or other layered materials, e.g., silicon nitride ($Si_xN_y$) or silicon carbide (SiC). Diaphragm 110 may include one or more layers. Actuator 120, for example, may include a first electrode 122 and a second electrode 126. Actuator 120 may be arranged along a perimeter of diaphragm 110, e.g., on diaphragm 110 where the bending is at a maximum. The electrodes may, for example, have a thickness between a few 100 nm, e.g., between 100 nm and 500 nm. Between the electrodes, piezoelectric layer 124 may be formed, e.g., from PZT or AN. The piezoelectric layer 124 may, for example have a thickness of 2 μm. By application of an electrical voltage, the piezoelectric layer 124 may tense or compress so that diaphragm 110 may transfer from geometrically stable position 110-1 to geometrically stable position 110-2, or vice versa.

Thus, microelectromechanical device 300 may create sound from a digital input via the sudden switch (e.g., an abrupt or prompt switch or transfer) between the bistable positions, which creates a high acceleration of diaphragm 110, and thus, a high acceleration of the surrounding medium of diaphragm 110, e.g., a fluid such as air. This acceleration is, in turn, proportional to the created sound pressure of the corresponding sound pulse. This acceleration, however, may be equal in amplitude in both directions between the geometrically stable positions of diaphragm 110.

Accordingly, via the piezoelectric actuator 120, diaphragm 110 may be controlled between bistable positions, e.g., after creation of a sound wave (or sound pulse), diaphragm 110 is controlled from the end-position (e.g., position 110-2) back to the start-position (e.g., position 110-1). Therefore, for example, microelectromechanical device 300A, e.g., a pixel in an array (see below), may be used again to create another sound wave. This is advantageous as the sound wave created due to transfer of the diaphragm from, e.g., position 110-1 to 110-2 may have the same amplitude as transfer from, e.g., position 110-2 to 110-1, i.e., when the dynamics of transfer in both directions are identical. Thus, the opposing sound waves corresponding to transfer in opposite directions have opposite signs, which when aggregated, results in cancellation. Therefore, to effectively create sound waves, diaphragm 110 may be switched in one direction differently than in the other direction between the bistable positions (e.g., when diaphragm 110 is moving between the bistable positions).

Controller 150 may be a circuit that converts the digital sound input into the electrical control signal, e.g., an analog control signal that corresponds to the digital sound input, which may be provided to actuator 120. Through the inverse piezoelectric effect, piezoelectric layer 124 of actuator 120 may exert a force on diaphragm 110 that moves the diaphragm to create the sound wave in accordance with the digital sound input. Actuator 120 may thus receive the electrical control signal to move the diaphragm from one geometrically stable position into the other geometrically stable position to create the sound wave.

Switching of the position of diaphragm 110 may be monitored by electrical means due to the mechanical deformation of diaphragm 110 and thus an impedance change in the coupled piezoelectric layer 124, i.e., actuator 120 may also be configured as a sensor 130. Actuator 120 may be further configured to receive a further electrical control signal from the controller to control the diaphragm in a geometrically instable position between the two geometrically stable positions.

Figure 3B:
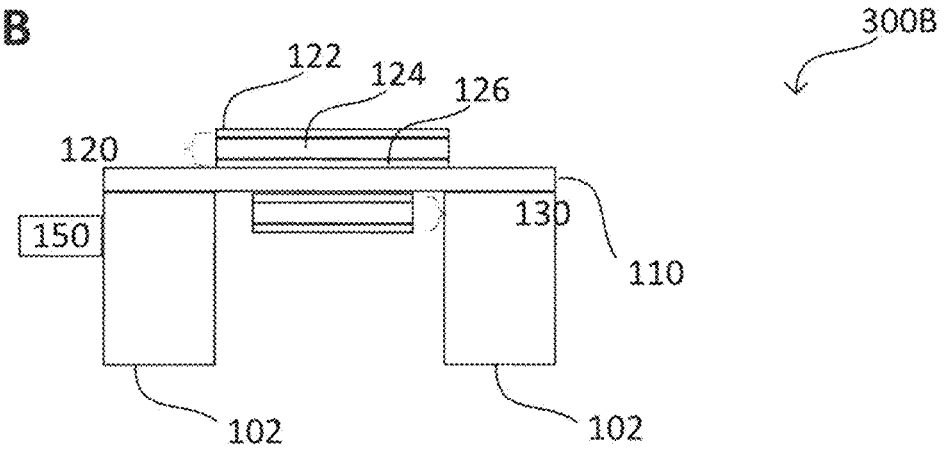
Figure 3C:
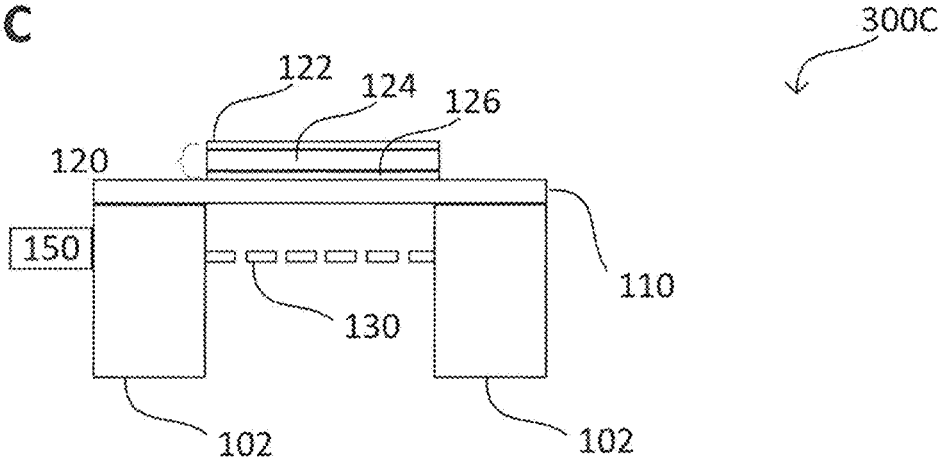

Integration of a further piezoelectric element, e.g., sensor 130 in FIG. 3B, or an electrode for capacitive measurement, e.g., sensor 130 in FIG. 3C, may allow for an exacting absolute-position determination of diaphragm 110 in the unstable region. Integrated sensor 130 may also be configured to monitor the absolution position determination of diaphragm 110 in one of the two geometrically stable positions to additionally determine deterioration (e.g., as a self-test, for example, for wear or stress-relaxation) of diaphragm 110 or actuator 120. Furthermore, polarization charges may be discharged through transfer between geometrically stable positions, the total amount of which may have indirect interference with the absolute position of the diaphragm 110.

With an appropriate first electrode 122, e.g., in accordance with *Modal Optimization and Filtering in Piezoelectric Microplate Resonators* by J. L. Sanchez-Rojas, J. Hernando, A Donoso, J. C. Bellido, T. Manzaneque, A. Ababneh, H. Seidel, and U. Schmid, in the Journal of Micromechancis and Microengineering, Vol. 20, p. 055027 (7 pp), 2010, which is hereby incorporated by reference in its entirety herein, a desired positional transfer of the pre-stressed diaphragm 110 may be enhanced, and thereby the potential of the thin-film actuator 120 and sensor 130 may be increased.

Figure 4A:
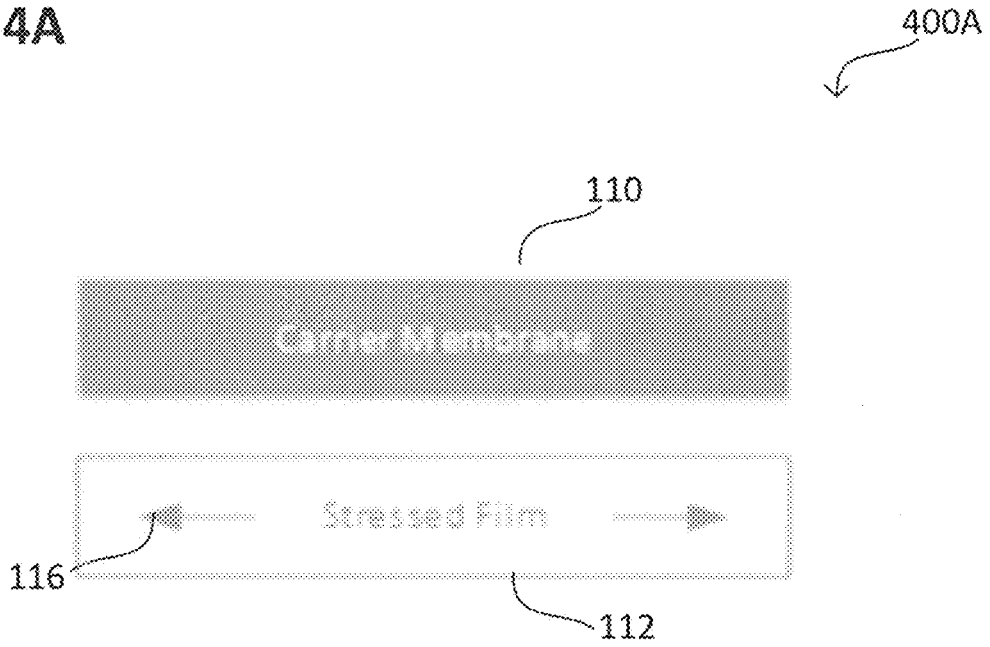
FIGS. 4A & 4B show a diaphragm, pre-stressed layer, and an actuator.
Figure 4B:
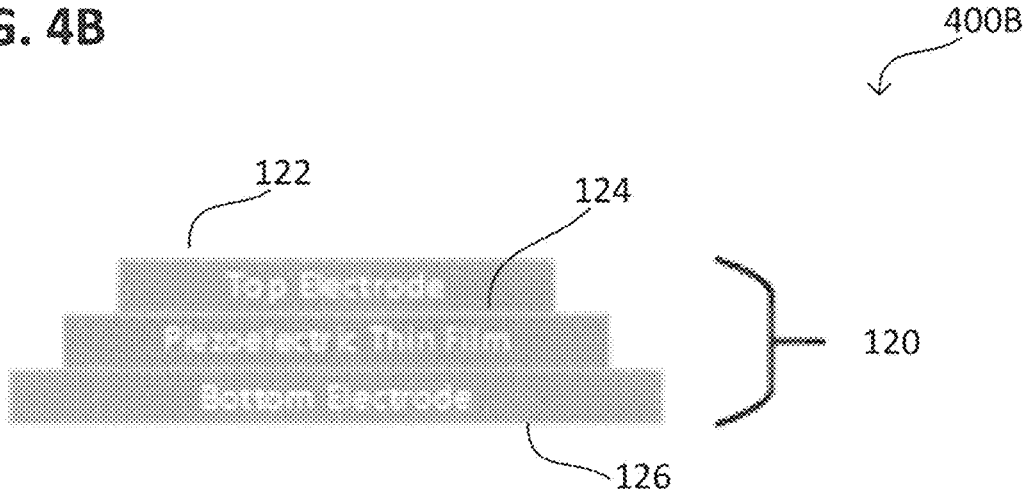

FIGS. 4A and 4B may show diagram 400A and 400B of diaphragm 110, stressed region 112, and actuator 120. To pre-stress diaphragm 110, as discussed above, in an aspect of the disclosure, an additional stressed layer may be applied to diaphragm 110, e.g., a thin film may form stressed region 112. The layer may include tungsten (W). Additionally or alternatively, one of the layers of actuator 120 may be compressively stressed to impart the stressed region 112 on diaphragm 110. An additional layer may thus be saved.

FIG. 5A-5E may show various aspects of a bistable diaphragm 110 with an actuator 120, i.e., various aspects of imparting stressed region 112 on diaphragm 110 in cross-section. The actuator 120 may include a first electrode 126, a piezoelectric layer 124 (e.g., a thin-layer), and a second electrode 126. The second electrode 126 may be formed from a metallic thin-film, as well as a doped region, e.g., a highly-doped region, of the diaphragm 110 (a semiconductor material). The individual components may be the diaphragm 110, a stressed thin-film, and the actuator 120. These may be arranged in different ways and a particular layer may be configured for multiple tasks. For example, the second electrode 126 may be compressed and may also be a part of the actuator 120, i.e., in addition to a role as the stressed layer. Compressive stress gradients may also be formed in diaphragm 110 through implantation (e.g., a structural dopant such as carbon) and this region of diaphragm 110 may simultaneously be used as a second electrode 126 through near-surface additional doping.

Diaphragm 110 may further include a pre-stressed layer mechanically coupled to a surface of the diaphragm 110 to impart the stressed region. Actuator 120 may include a pre-stressed layer mechanically coupled over a surface of the diaphragm 110 to impart the stressed region. The pre-stressed layer of actuator 120 may be at least one of a first electrode 122 mechanically coupled to a top surface of the piezoelectric layer 124, the piezoelectric layer 124, and a second electrode mechanically coupled to a bottom surface of the piezoelectric layer over the diaphragm 110.

Figure 5A:
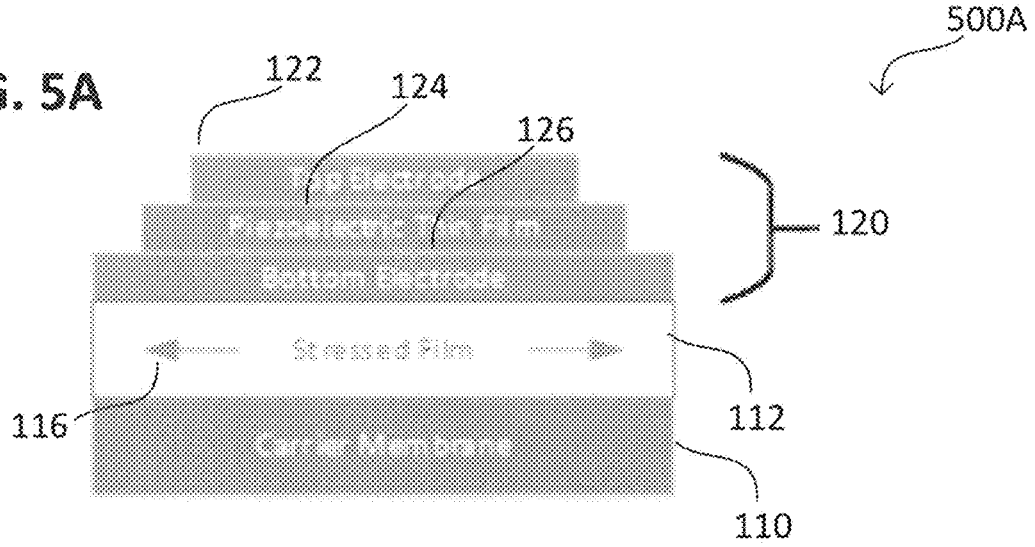
FIG. 5A-5E show various aspects of a bistable diaphragm with an actuator.

FIG. 5A may include diaphragm 110 with an additional layer to impart the stressed region 112. Arrows 116 may indicate the pre-stressed element. Actuator 120 may include first electrode 122, piezoelectric layer 124, and second electrode 126.

Figure 5B:
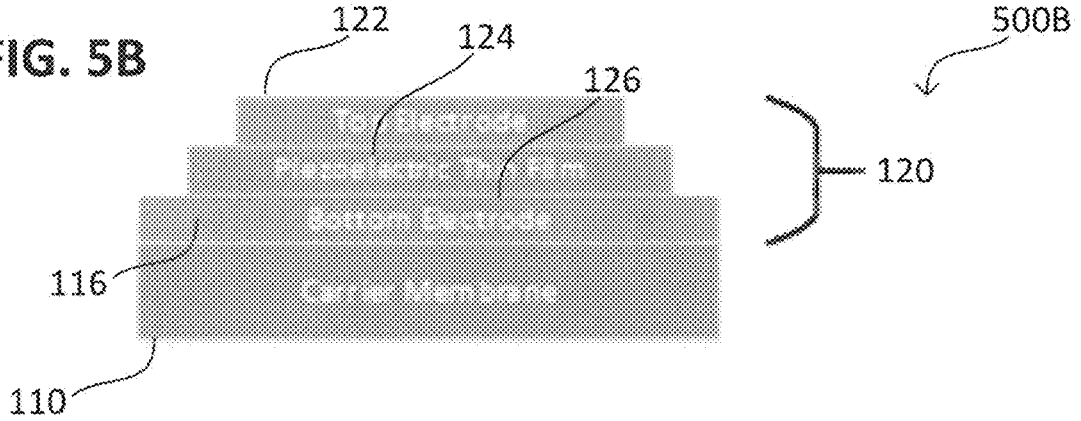

Actuator 120 in FIG. 5B may include first electrode 122, piezoelectric layer 124, and second electrode 126. Second electrode 126 may be pre-stressed to impart a stressed region to diaphragm 110. Arrows 116 may indicate the pre-stressed element.

Figure 5C:
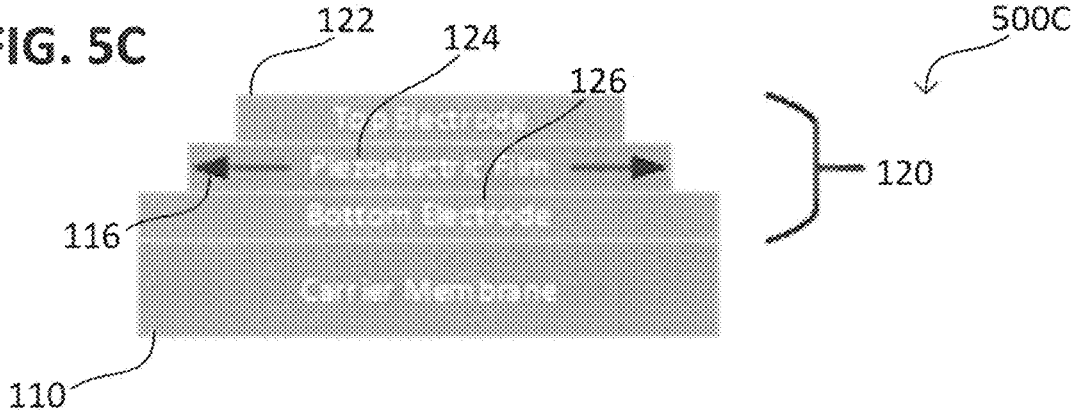

In FIG. 5C, piezoelectric layer 124 of actuator 120 may be pre-stressed. Arrows 116 may indicate the pre-stressed element. Thus, the stressed region of the diaphragm 110 may be imparted by piezoelectric layer 124.

Figure 5D:
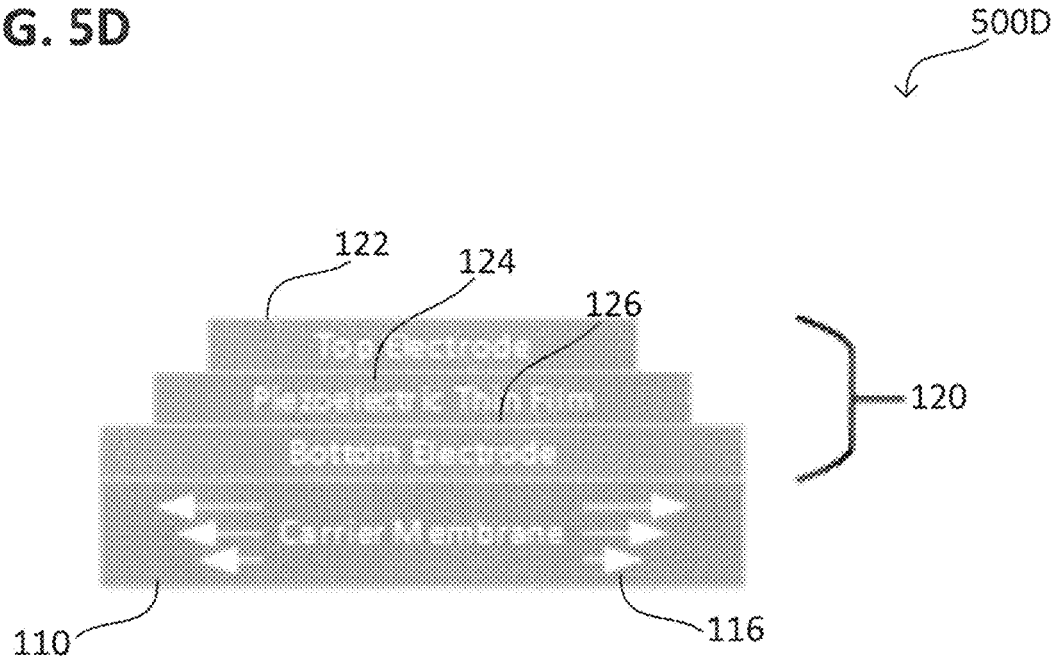

Diaphragm 110 may include structural dopants in FIG. 5D to impart the stressed region. Arrows 116 may indicate the pre-stressed element. None of the elements in actuator 120 may be pre-stressed.

Figure 5E:
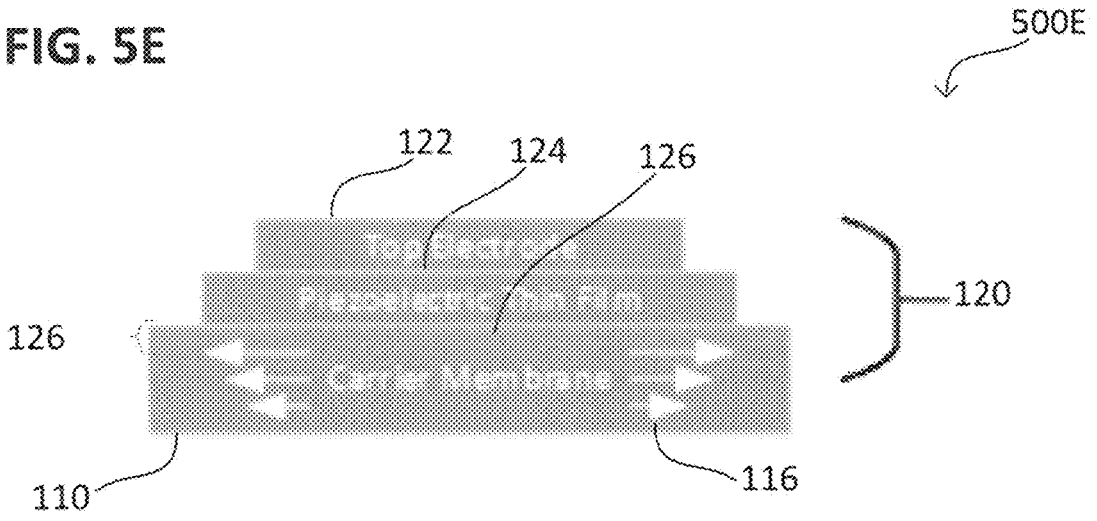

Again, in FIG. 5E, diaphragm 110 may include structural dopants to impart the stressed region. In addition, second electrode 126 may be formed in a region of diaphragm 110, e.g., a doped region (to increase conductivity). Thus, actuator 120 may include first electrode 122 over piezoelectric layer 124, which are over diaphragm 110, while second electrode 126 of actuator 120 is in diaphragm 110.

Figure 6:
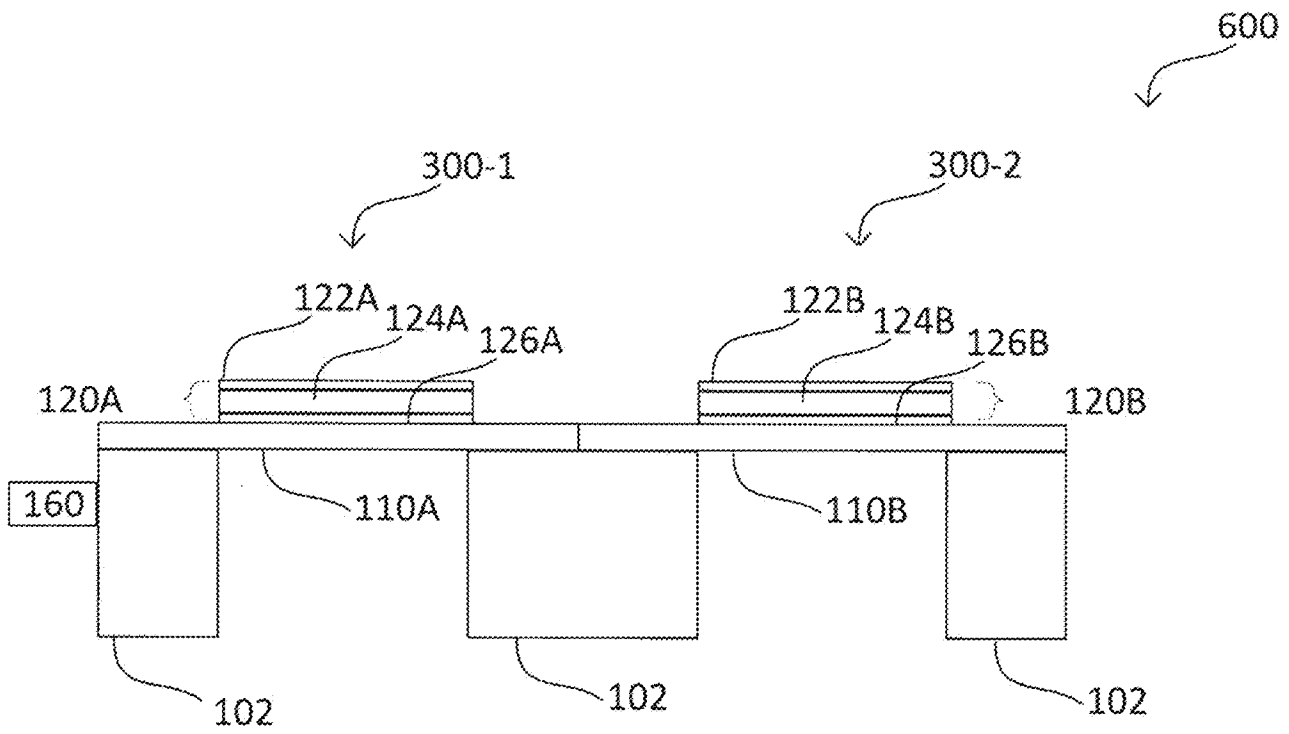
FIG. 6 shows an array of microelectromechanical devices.

FIG. 6 shows an array 600 of microelectromechanical devices. On the basis of the high precision handling in the area of silicon micro-technologies, many microelectromechanical devices as have been described may be compactly arranged in an array, so that a sufficiently high volume and resolution may be realized for sound generation. The array may be digitally controlled bit-wise (as a pixel) or in bit-groups, e.g., individually or in groups. The digital control may typically have a sampling frequency considerably over the audible-region, e.g., at 80 kHz. To digitally reconstruct the sound input, positive sound pulses are created in one direction, i.e., a direction of transfer from one of the two geometrically stable positions of diaphragm 110, and a negative sound pulse is created by a sound pulse in the opposite direction. Thus, via deft allocation of a pixel or bit-group of an array, the actual position (of respective diaphragms) may be reset with regard to the particular cycle of the created sound wave (e.g., aggregate sound wave), i.e., the respective diaphragms may be controlled to return to a starting position so as not to substantially affect the creation of the aggregate sound wave.

Array 600 of microelectromechanical devices (e.g., such as microelectromechanical device 300A, supra), may include: a substrate 102; a plurality of microelectromechanical devices (e.g., microelectromechanical devices 300-1 and 300-2) arranged on the substrate 102, wherein each of the plurality of microelectromechanical devices may include: a diaphragm (e.g., diaphragms 110A and 110B) mechanically coupled to the substrate 102, the diaphragm including a stressed region to buckle the diaphragm into one of two geometrically stable positions; an actuator (e.g., actuators 120A and 120B) mechanically coupled to the diaphragm, the actuator including a piezoelectric layer (e.g., piezoelectric layers 124A and 124B) over the diaphragm; a controller (not pictured here) configured to provide an electrical control signal in response to a digital sound input; wherein the actuator is configured to receive the electrical control signal to exert a mechanical piezoelectric force on the diaphragm via the piezoelectric layer to move the diaphragm to create a sound wave; and an array controller 160 coupled to the plurality of microelectromechanical devices configured to control the respective microelectromechanical devices with electrical control signals in accordance with the digital sound input to create an aggregate sound wave.

Although array 600 is illustrated with two microelectromechanical devices 300-1 and 300-2 in FIG. 6, any number of individual microelectromechanical devices may form array 600, e.g., a two-dimensional array (m,n), with m in the range of 1 to 65,536 and n in the range of 1 to 65,536, wherein if m or n is equal to 1, then m is not equal to n.

The plurality of microelectromechanical devices may include a plurality of groups of respective microelectromechanical devices, e.g., bit-groups, and the array controller 160 may be further configured to control the respective groups of microelectromechanical devices with electrical control signals in accordance with the digital sound input to create the aggregate sound wave.

Each of the microelectromechanical devices of the array 600 may be the same or similar to microelectromechanical devices described supra, e.g., 300A-300C, and, therefore, may not be described again in detail here.

Figure 7:
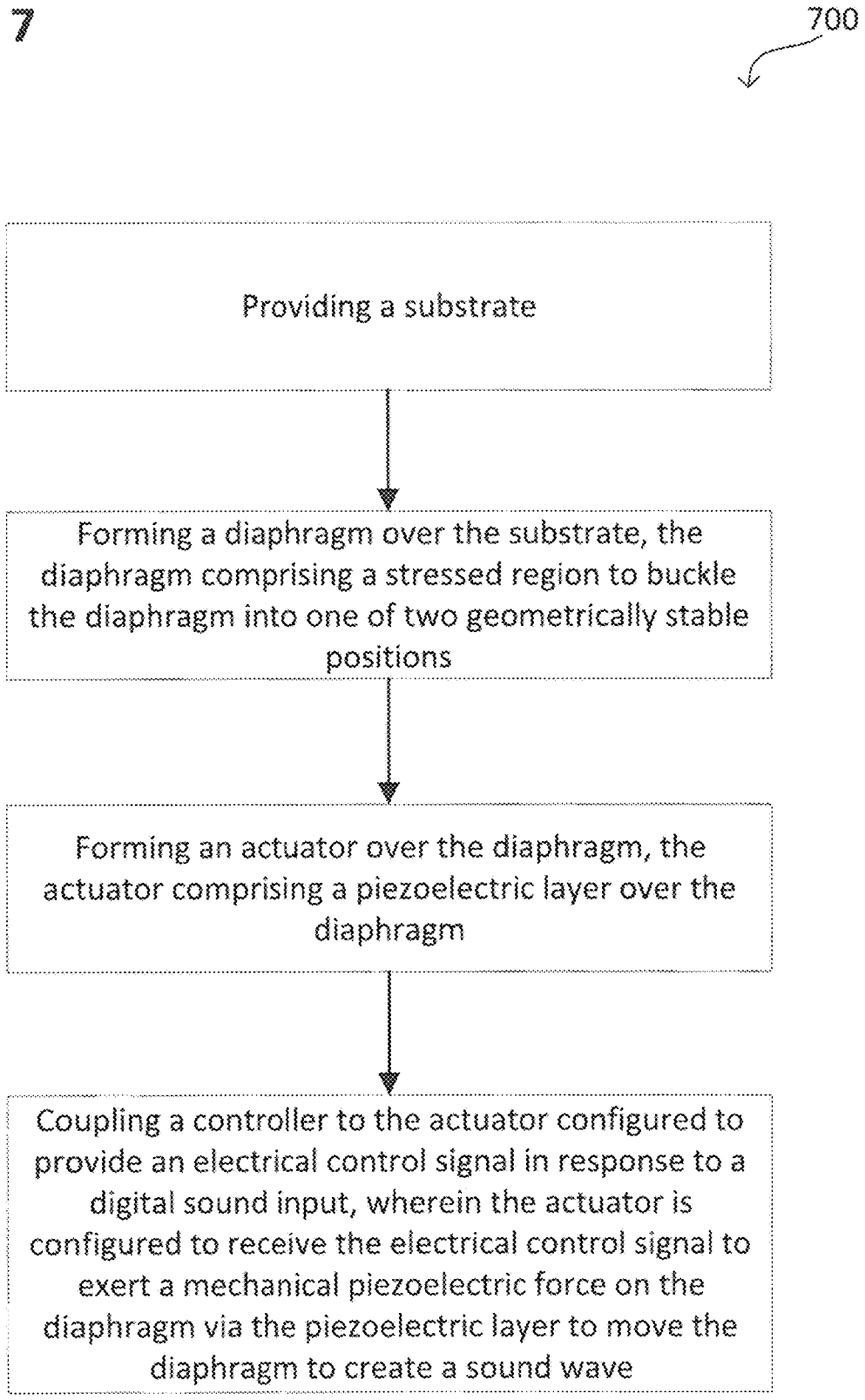
FIG. 7 shows a diagram of a method of manufacturing a microelectromechanical device.

FIG. 7 may show a method 700 of manufacturing a microelectromechanical device, e.g., microelectromechanical device 300A. The method may include: providing a substrate; forming a diaphragm over the substrate, the diaphragm including a stressed region to buckle the diaphragm into one of two geometrically stable positions; forming an actuator over the diaphragm, the actuator including a piezoelectric layer over the diaphragm; coupling a controller to the actuator configured to provide an electrical control signal in response to a digital sound input; wherein the actuator is configured to receive the electrical control signal to exert a mechanical piezoelectric force on the diaphragm via the piezoelectric layer to move the diaphragm to create a sound wave.

The substrate of method 700 may include a semiconductor material, such as silicon. The silicon may be a monocrystalline silicon or a polycrystalline silicon. Additionally or alternatively, the semiconductor material may be a silicon compound, such as amorphous silicon carbide or polycrystalline silicon carbide.

Likewise, the diaphragm may include a semiconductor material. The semiconductor may be silicon or a silicon compound, e.g., monocrystalline silicon, polycrystalline silicon, amorphous monocrystalline silicon, or polycrystalline silicon carbide.

In method 700, the diaphragm may be formed to have a circular form. The stressed region may cover an entire surface of the circular form or may partially cover a surface of the circular form. For example, the stressed region may be formed along two diameters of the circular form. The diameters may be perpendicular. The stressed region may be formed along a circumference of the circular form. The stressed region may, therefore, extend a substantially uniform predefined distance from the circumference.

The diaphragm may have an elliptical form and the stressed region may cover an entire surface of the circular form.

In another aspect of the disclosure, the diaphragm may have a polygonal form, such as rectangular form or a square form. The stressed region may cover an entire surface of the rectangular form or the square form. Alternatively, the stressed region may partially cover a surface of the square form. The stressed region may be formed along two bisectors (e.g., lateral or angular) of the square form.

The piezoelectric layer of the actuator may include aluminum nitride (AlN), zinc oxide (ZnO), or lead zirconate titanate (PZT). The controller may be a circuit.

Forming the diaphragm including the stressed region in method 700 may further include doping the stressed region with a structural dopant, e.g., carbon.

Additionally or alternatively, forming the diaphragm including the stressed region may include forming a pre-stressed layer over the diaphragm to impart the stressed region. The pre-stressed layer may include tungsten (W).

Forming the actuator over the diaphragm may include forming a pre-stressed layer of the actuator over a surface of the diaphragm to impart the stressed region. The pre-stressed layer of the actuator may be at least one of: a first electrode mechanically coupled to a top surface of the piezoelectric layer, the piezoelectric layer, and a second electrode mechanically coupled to a bottom surface of the piezoelectric layer over the diaphragm.

In method 700, forming the actuator over the diaphragm may include forming a second electrode over the diaphragm. The second electrode may include an electrically conductive material, such as a metal. The metal may be or include aluminum, gold, or platinum. Forming the actuator over the diaphragm may further include forming the piezoelectric layer over the diaphragm. The piezoelectric layer may include aluminum nitride (AlN), zinc oxide (ZnO), or lead zirconate titanate (PZT). Forming the actuator over the diaphragm may further include forming a first electrode over a top surface of the piezoelectric layer. The first electrode may include an electrically conductive material. The electrically conductive material may be a metal, e.g., at least one of aluminum, gold, and platinum.

Method 700 may further include coupling a sensor to the diaphragm configured to determine a position of the diaphragm between the two geometrically stable positions. Coupling the sensor to the diaphragm may further include forming a further piezoelectric layer over the diaphragm. The further piezoelectric layer may include aluminum nitride (AlN), zinc oxide (ZnO), or lead zirconate titanate (PZT). Coupling the sensor to the diaphragm may further include forming an electrode configured to capacitively couple to the diaphragm. The electrode may include an electrically conductive material such as metal, which may be at least one of aluminum, gold, and platinum.

Figure 8A:
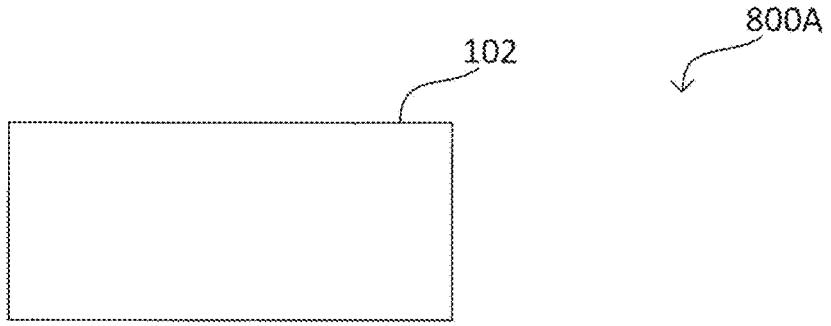
FIG. 8A-8D show aspects of a method of manufacturing a microelectromechanical device.
Figure 8B:
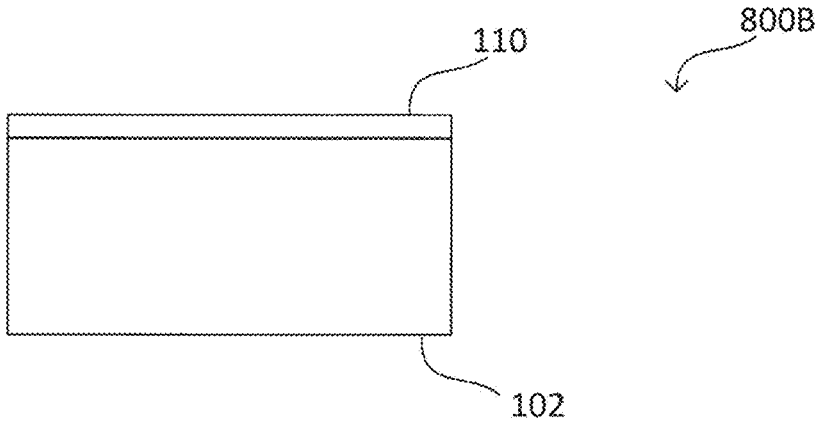
Figure 8C:
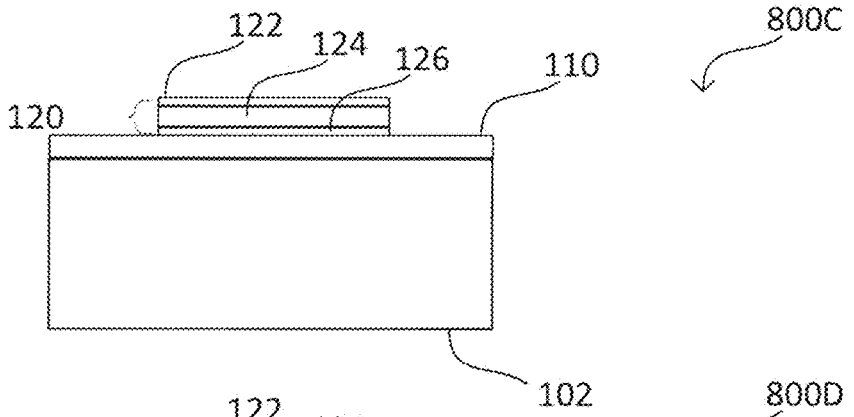
Figure 8D:
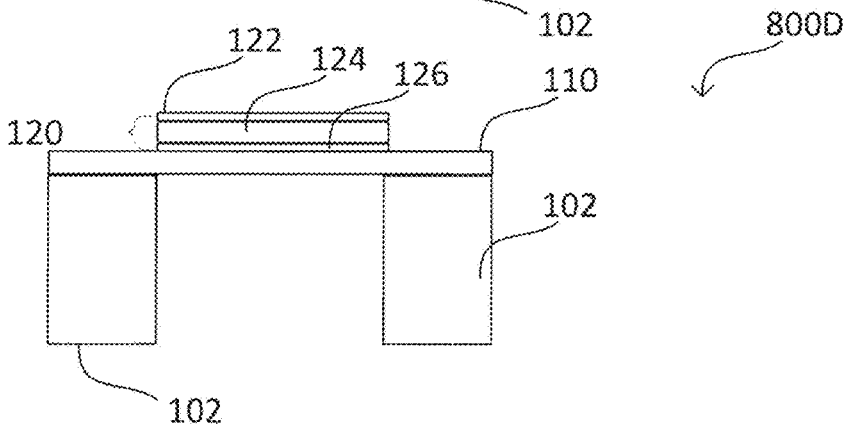

FIG. 8A-8D may show aspects of method 700. FIG. 8A may show providing a substrate 102. FIG. 8B may show forming a diaphragm 110 over the substrate 102, the diaphragm 110 including a stressed region to buckle the diaphragm 110 into one of two geometrically stable positions, e.g., position 110-1 and 110-2. FIG. 8C may show forming a actuator 120 (which may also be sensor 130) over the diaphragm 110, the actuator 120 including a piezoelectric layer 124 (and, for example, first electrode 122 and second electrode 126) over the diaphragm 110. In FIG. 8D, part of substrate 102 may be removed to release diaphragm 110 and form a microelectromechanical device 300. Not shown here may be coupling a controller to the actuator 120 configured to provide an electrical control signal in response to a digital sound input, wherein the actuator 120 is configured to receive the electrical control signal to exert a mechanical piezoelectric force on the diaphragm 110 via the piezoelectric layer 124 to move the diaphragm 110 to create a sound wave.

Figure 9:
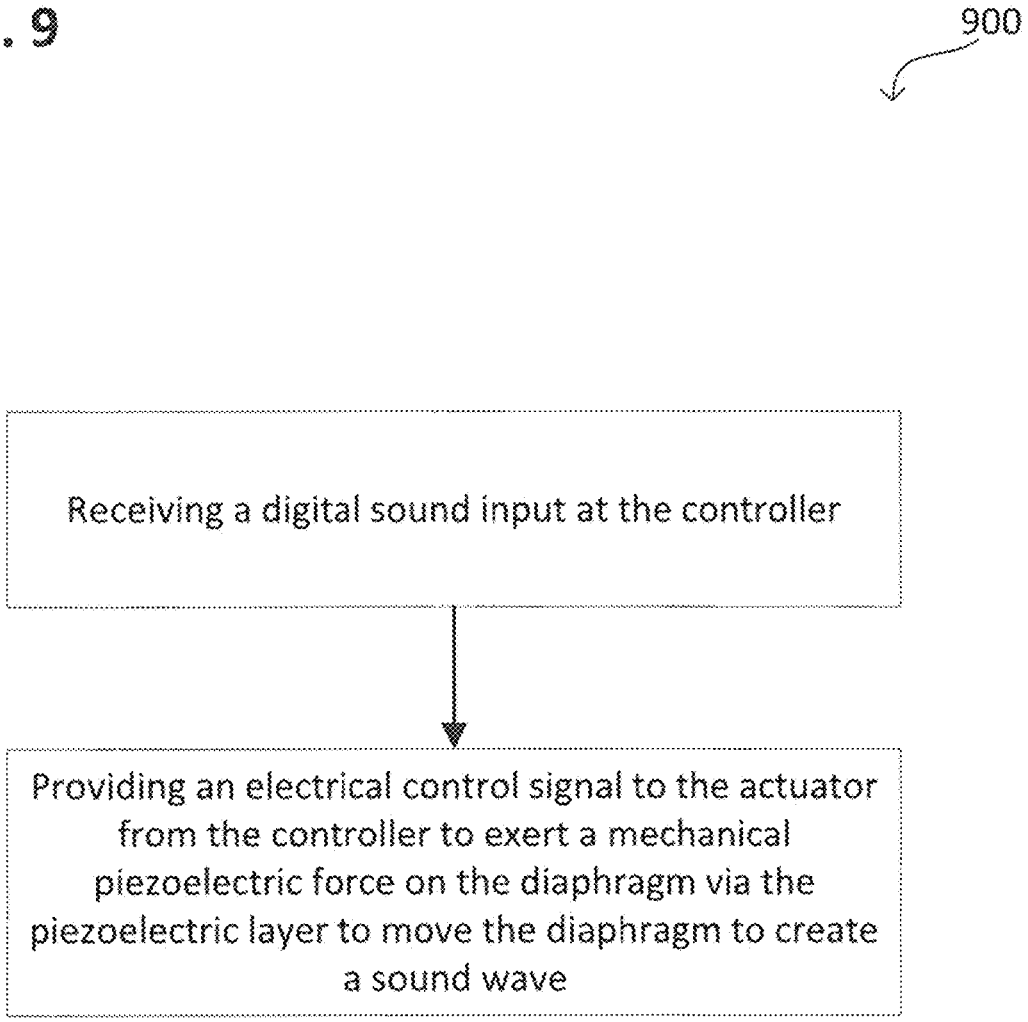
FIG. 9 shows a diagram of a method of operating a microelectromechanical device.

FIG. 9 may show a method 900 of operating a microelectromechanical device including: a substrate, a diaphragm mechanically coupled to the substrate, the diaphragm including a stressed region to buckle the diaphragm into one of two geometrically stable positions; an actuator mechanically coupled to the diaphragm, the actuator including a piezoelectric layer over the diaphragm; and a controller coupled to the actuator, the method 900 including: receiving a digital sound input at the controller; and providing an electrical control signal to the actuator from the controller to exert a mechanical piezoelectric force on the diaphragm via the piezoelectric layer to move the diaphragm to create a sound wave.

The microelectromechanical device may further include a sensor coupled to the diaphragm and the method 900 may further include determining a position of the diaphragm via the sensor between the two geometrically stable positions. Method 900 may further include: determining a first position of the diaphragm via the sensor in one of the two geometrically stable positions and determining a second position via the sensor in the other of the two geometrically stable positions. The microelectromechanical device may further include a memory coupled to the sensor and method 900 may further include: comparing the first position and the second position determined via the sensor to a previously stored first position and second position in the memory to calibrate the microelectromechanical device or to test the diaphragm for a stress-relaxation.

The mechanical piezoelectric force may be a critical force that overcomes an equilibrium force maintaining the diaphragm in one of the two geometrically stable positions, e.g., to create the sound wave, a minimal energy may be expended to move, e.g., transfer, the diaphragm to create the sound wave.

Method 900 may further include controlling the actuator to exert a counter force against a movement of the diaphragm. The counter force may decelerate the movement of the diaphragm or the counter force may maintain a position of the diaphragm in an unstable region between the two geometrically stable positions.

In an aspect of the disclosure, Example 1 may be a microelectromechanical device including: a substrate; a diaphragm mechanically coupled to the substrate, the diaphragm including a stressed region to buckle the diaphragm into one of two geometrically stable positions; an actuator mechanically coupled to the diaphragm, the actuator including a piezoelectric layer over the diaphragm; a controller configured to provide an electrical control signal in response to a digital sound input; wherein the actuator is configured to receive the electrical control signal to exert a mechanical piezoelectric force on the diaphragm via the piezoelectric layer to move the diaphragm to create a sound wave.

Example 2 may include Example 1, wherein the substrate includes a semiconductor.

Example 3 may include Example 2, wherein the semiconductor includes silicon.

Example 4 may include Example 3, wherein the silicon is monocrystalline silicon.

Example 5 may include Example 3, wherein the silicon is polycrystalline silicon.

Example 6 may include Example 3, wherein the silicon is amorphous silicon carbide.

Example 7 may include Example 3, wherein the silicon is polycrystalline silicon carbide.

Example 8 may include any one of Examples 1-7, wherein the diaphragm includes a semiconductor.

Example 9 may include Example 8, wherein the semiconductor includes silicon.

Example 10 may include Example 8, wherein the silicon is monocrystalline silicon.

Example 11 may include Example 8, wherein the silicon is polycrystalline silicon.

Example 12 may include Example 8, wherein the silicon is amorphous silicon carbide.

Example 13 may include Example 8, wherein the silicon is polycrystalline silicon carbide.

Example 14 may include any one of Examples 1-13, wherein the diaphragm has a circular form.

Example 15 may include Example 14, wherein the stressed region covers an entire surface of the circular form.

Example 16 may include Example 14, wherein the stressed region partially covers a surface of the circular form.

Example 17 may include Example 16, wherein the stressed region is formed along two diameters of the circular form.

Example 18 may include Example 17, wherein the diameters are perpendicular.

Example 19 may include Example 16, wherein the stressed region is formed along a circumference of the circular form.

Example 20 may include Example 19, wherein the stressed region along the circumference of the circular form extends a substantially uniform predefined distance from the circumference.

Example 21 may include any one of Examples 1-13, wherein the diaphragm has an elliptical form.

Example 22 may include Example 21, wherein the stressed region covers an entire surface of the elliptical form.

Example 23 may include any one of Examples 1-13, wherein the diaphragm has a polygonal form.

Example 24 may include Example 23, wherein the diaphragm has a rectangular form.

Example 25 may include Example 24, wherein the stressed region covers an entire surface of the rectangular form.

Example 26 may include Example 24, wherein the rectangular form is a square form.

Example 27 may include Example 26, wherein the stressed region covers an entire surface of the square form.

Example 28 may include Example 26, wherein the stressed region partially covers a surface of the square form.

Example 29 may include Example 28, wherein the stressed region is formed along two bisectors of the square form.

Example 30 may include any one of Examples 1-29, wherein the piezoelectric layer includes aluminum nitride.

Example 31 may include any one of Examples 1-29, wherein the piezoelectric layer includes zinc oxide.

Example 32 may include any one of Examples 1-29, wherein the piezoelectric layer includes lead zirconate titanate.

Example 33 may include any one of Examples 1-32, wherein the controller is a circuit.

Example 34 may include any one of Examples 1-33, wherein the actuator is further configured to receive a further electrical control signal from the controller to control the diaphragm in a geometrically instable position between the two geometrically stable positions.

Example 35 may include any one of Examples 1-34, wherein the actuator is further configured to receive the electrical control signal to move the diaphragm from one geometrically stable position into the other geometrically stable position to create the sound wave.

Example 36 may include any one of Examples 1-35, further including: a sensor coupled to the diaphragm configured to determine a position of the diaphragm between the two geometrically stable positions.

Example 37 may include Example 36, wherein the sensor includes a further piezoelectric layer mechanically coupled to the diaphragm.

Example 38 may include Example 37, wherein the further piezoelectric layer includes aluminum nitride.

Example 39 may include Example 37, wherein the further piezoelectric layer includes zinc oxide.

Example 40 may include Example 37, wherein the further piezoelectric layer includes lead zirconate titanate.

Example 41 may include Example 36, wherein the sensor includes an electrode capacitively coupled to the diaphragm.

Example 42 may include Example 41, wherein the electrode includes an electrically conductive material.

Example 43 may include Example 42, wherein the electrically conductive material is a metal.

Example 44 may include Example 43, wherein the metal includes at least one of the group consisting of: aluminum, gold, and platinum.

Example 45 may include any one of Examples 1-35, wherein the piezoelectric layer of the actuator is further configured as a sensor to determine a position of the diaphragm between the two geometrically stable positions.

Example 46 may include any one of Examples 1-45, wherein the actuator further includes a first electrode mechanically coupled to a top surface of the piezoelectric layer.

Example 47 may include Example 46, wherein the first electrode includes an electrically conductive material.

Example 48 may include Example 47, wherein the electrically conductive material is a metal.

Example 49 may include Example 48, wherein the metal includes at least one of the group consisting of: aluminum, gold, and platinum.

Example 50 may include Example 46, wherein the actuator further includes a second electrode mechanically coupled to a bottom surface of the piezoelectric layer over the diaphragm.

Example 51 may include Example 50, wherein the second electrode includes an electrically conductive material.

Example 52 may include Example 51, wherein the electrically conductive material is a metal.

Example 53 may include Example 52, wherein the metal includes at least one of the group consisting of: aluminum, gold, and platinum.

Example 54 may include Example 46, wherein the diaphragm further includes a conductive region configured as a second electrode mechanically coupled to a bottom surface of the piezoelectric layer.

Example 55 may include Example 54, wherein the second electrode includes a semiconductor.

Example 56 may include Example 55, wherein the semiconductor is a doped semiconductor.

Example 57 may include any one of Example 1-56, wherein the stressed region of the diaphragm includes a structural dopant.

Example 58 may include Example 57, wherein the structural dopant is carbon.

Example 59 may include any one of Examples 1-56, wherein the diaphragm further includes a pre-stressed layer mechanically coupled to a surface of the diaphragm to impart the stressed region.

Example 60 may include Example 59, wherein the pre-stressed-layer includes tungsten.

Example 61 may include any one of Examples 1-56, wherein the actuator includes a pre-stressed layer mechanically coupled over a surface of the diaphragm to impart the stressed region.

Example 62 may include Example 61, wherein the pre-stressed layer of the actuator is at least one of the group of layers consisting of: a first electrode mechanically coupled to a top surface of the piezoelectric layer, the piezoelectric layer, and a second electrode mechanically coupled to a bottom surface of the piezoelectric layer over the diaphragm.

In an aspect of the disclosure, Example 63 may be an array of microelectromechanical devices including: a substrate; a plurality of microelectromechanical devices arranged on the substrate, wherein each of the plurality of microelectromechanical devices include: a diaphragm mechanically coupled to the substrate, the diaphragm including a stressed region to buckle the diaphragm into one of two geometrically stable positions; an actuator mechanically coupled to the diaphragm, the actuator including a piezoelectric layer over the diaphragm; a controller configured to provide an electrical control signal in response to a digital sound input; wherein the actuator is configured to receive the electrical control signal to exert a mechanical piezoelectric force on the diaphragm via the piezoelectric layer to move the diaphragm to create a sound wave; and an array controller coupled to the plurality of microelectromechanical devices configured to control the respective microelectromechanical devices with electrical control signals in accordance with the digital sound input to create an aggregate sound wave.

Example 64 may include Example 63, wherein the substrate includes a semiconductor.

Example 65 may include Example 64, wherein the semiconductor includes silicon.

Example 66 may include Example 65, wherein the silicon is monocrystalline silicon.

Example 67 may include Example 65, wherein the silicon is polycrystalline silicon.

Example 68 may include Example 65, wherein the silicon is amorphous silicon carbide.

Example 69 may include Example 65, wherein the silicon is polycrystalline silicon carbide.

Example 70 may include any one of Examples 63-69, wherein the diaphragm includes a semiconductor.

Example 71 may include Example 70, wherein the semiconductor includes silicon.

Example 72 may include Example 71, wherein the silicon is monocrystalline silicon.

Example 73 may include Example 71, wherein the silicon is polycrystalline silicon.

Example 74 may include Example 71, wherein the silicon is amorphous silicon carbide.

Example 75 may include Example 71, wherein the silicon is polycrystalline silicon carbide.

Example 76 may include any one of Examples 63-75, wherein the diaphragm has a circular form.

Example 77 may include Example 76, wherein the stressed region covers an entire surface of the circular form.

Example 78 may include Example 76, wherein the stressed region partially covers a surface of the circular form.

Example 79 may include Example 78, wherein the stressed region is formed along two diameters of the circular form.

Example 80 may include Example 79, wherein the diameters are perpendicular.

Example 81 may include Example 78, wherein the stressed region is formed along a circumference of the circular form.

Example 82 may include Example 81, wherein the stressed region along the circumference of the circular form extends a substantially uniform predefined distance from the circumference.

Example 83 may include any one of Examples 63-75, wherein the diaphragm has an elliptical form.

Example 84 may include Example 83, wherein the stressed region covers an entire surface of the elliptical form.

Example 85 may include any one of Examples 63-75, wherein the diaphragm has a polygonal form.

Example 86 may include Example 85, wherein the diaphragm has a rectangular form.

Example 87 may include Example 86, wherein the stressed region covers an entire surface of the rectangular form.

Example 88 may include Example 86, wherein the rectangular form is a square form.

Example 89 may include Example 88, wherein the stressed region covers an entire surface of the square form.

Example 90 may include Example 88, wherein the stressed region partially covers a surface of the square form.

Example 91 may include Example 90, wherein the stressed region is formed along two bisectors of the square form.

Example 92 may include any one of Examples 63-91, wherein the piezoelectric layer includes aluminum nitride.

Example 93 may include any one of Examples 63-91, wherein the piezoelectric layer includes zinc oxide.

Example 94 may include any one of Examples 63-91, wherein the piezoelectric layer includes lead zirconate titanate.

Example 95 may include any one of Examples 63-94, wherein the controller is a circuit.

Example 96 may include any one of Examples 63-95, wherein the actuator is further configured to receive a further electrical control signal from the controller to control the diaphragm in a geometrically instable position between the two geometrically stable positions.

Example 97 may include any one of Examples 63-96, wherein the actuator is further configured to receive the electrical control signal to move the diaphragm from one geometrically stable position into the other geometrically stable position to create the sound wave.

Example 98 may include any one of Examples 63-97, further including: a sensor coupled to the diaphragm configured to determine a position of the diaphragm between the two geometrically stable positions.

Example 99 may include Example 98, wherein the sensor includes a further piezoelectric layer mechanically coupled to the diaphragm.

Example 100 may include Example 99, wherein the further piezoelectric layer includes aluminum nitride.

Example 101 may include Example 99, wherein the further piezoelectric layer includes zinc oxide.

Example 102 may include Example 99, wherein the further piezoelectric layer includes lead zirconate titanate.

Example 103 may include Example 98, wherein the sensor includes an electrode capacitively coupled to the diaphragm.

Example 104 may include Example 103, wherein the electrode includes an electrically conductive material.

Example 105 may include Example 104, wherein the electrically conductive material is a metal.

Example 106 may include Example 105, wherein the metal includes at least one of the group consisting of: aluminum, gold, and platinum.

Example 107 may include any one of Examples 63-97, wherein the piezoelectric layer of the actuator is further configured as a sensor to determine a position of the diaphragm between the two geometrically stable positions.

Example 108 may include any one of Examples 63-107, wherein the actuator further includes a first electrode mechanically coupled to a top surface of the piezoelectric layer.

Example 109 may include Example 108, wherein the first electrode includes an electrically conductive material.

Example 110 may include Example 109, wherein the electrically conductive material is a metal.

Example 111 may include Example 110, wherein the metal includes at least one of the group consisting of: aluminum, gold, and platinum.

Example 112 may include Example 108, wherein the actuator further includes a second electrode mechanically coupled to a bottom surface of the piezoelectric layer over the diaphragm.

Example 113 may include Example 112, wherein the second electrode includes an electrically conductive material.

Example 114 may include Example 113, wherein the electrically conductive material is a metal.

Example 115 may include Example 114, wherein the metal includes at least one of the group consisting of: aluminum, gold, and platinum.

Example 116 may include Example 108, wherein the diaphragm further includes a conductive region configured as a second electrode mechanically coupled to a bottom surface of the piezoelectric layer.

Example 117 may include Example 116, wherein the second electrode includes a semiconductor.

Example 118 may include Example 117, wherein the semiconductor is a doped semiconductor.

Example 119 may include any one of Examples 63-118, wherein the stressed region of the diaphragm includes a structural dopant.

Example 120 may include Example 119, wherein the structural dopant is carbon.

Example 121 may include any one of Examples 63-118, wherein the diaphragm further includes a pre-stressed layer mechanically coupled to a surface of the diaphragm to impart the stressed region.

Example 122 may include Example 121, wherein the pre-stressed-layer includes tungsten.

Example 123 may include any one of Examples 63-118, wherein the actuator includes a pre-stressed layer mechanically coupled over a surface of the diaphragm to impart the stressed region.

Example 124 may include Example 123, wherein the pre-stressed layer of the actuator is at least one of the group of layers consisting of: a first electrode mechanically coupled to a top surface of the piezoelectric layer, the piezoelectric layer, and a second electrode mechanically coupled to a bottom surface of the piezoelectric layer over the diaphragm.

Example 125 may include any one of Examples 63-124, wherein the plurality of microelectromechanical devices includes a plurality of groups of respective microelectromechanical devices; wherein the array controller is further configured to control the respective groups of microelectromechanical devices with electrical control signals in accordance with the digital sound input to create the aggregate sound wave.

In an aspect of the disclosure, Example 126 may be a method of manufacturing a microelectromechanical device including: providing a substrate; forming a diaphragm over the substrate, the diaphragm including a stressed region to buckle the diaphragm into one of two geometrically stable positions; forming an actuator over the diaphragm, the actuator including a piezoelectric layer over the diaphragm; coupling a controller to the actuator configured to provide an electrical control signal in response to a digital sound input; wherein the actuator is configured to receive the electrical control signal to exert a mechanical piezoelectric force on the diaphragm via the piezoelectric layer to move the diaphragm to create a sound wave.

Example 127 may include Example 126, wherein the substrate includes a semiconductor.

Example 128 may include Example 127, wherein the semiconductor includes silicon.

Example 129 may include Example 128, wherein the silicon is monocrystalline silicon.

Example 130 may include Example 128, wherein the silicon is polycrystalline silicon.

Example 131 may include Example 128, wherein the silicon is amorphous silicon carbide.

Example 132 may include Example 128, wherein the silicon is polycrystalline silicon carbide.

Example 133 may include any one of Examples 126-132, wherein the diaphragm includes a semiconductor.

Example 134 may include Example 133, wherein the semiconductor includes silicon.

Example 135 may include Example 134, wherein the silicon is monocrystalline silicon.

Example 136 may include Example 134, wherein the silicon is polycrystalline silicon.

Example 137 may include Example 134, wherein the silicon is amorphous silicon carbide.

Example 138 may include Example 134, wherein the silicon is polycrystalline silicon carbide.

Example 139 may include any one of Examples 126-138, wherein the diaphragm has a circular form.

Example 140 may include Example 139, wherein the stressed region covers an entire surface of the circular form.

Example 141 may include Example 139, wherein the stressed region partially covers a surface of the circular form.

Example 142 may include Example 141, wherein the stressed region is formed along two diameters of the circular form.

Example 143 may include Example 142, wherein the diameters are perpendicular.

Example 144 may include Example 141, wherein the stressed region is formed along a circumference of the circular form.

Example 145 may include Example 144, wherein the stressed region along the circumference of the circular form extends a substantially uniform predefined distance from the circumference.

Example 146 may include any one of Examples 126-138, wherein the diaphragm has an elliptical form.

Example 147 may include Example 146, wherein the stressed region covers an entire surface of the elliptical form.

Example 148 may include any one of Examples 126-138, wherein the diaphragm has a polygonal form.

Example 149 may include Example 148, wherein the diaphragm has a rectangular form.

Example 150 may include Example 149, wherein the stressed region covers an entire surface of the rectangular form.

Example 151 may include Example 149, wherein the rectangular form is a square form.

Example 152 may include Example 151, wherein the stressed region covers an entire surface of the square form.

Example 153 may include Example 151, wherein the stressed region partially covers a surface of the square form.

Example 154 may include Example 153, wherein the stressed region is formed along two bisectors of the square form.

Example 155 may include any one of Examples 126-154, wherein the piezoelectric layer includes aluminum nitride.

Example 156 may include any one of Examples 126-154, wherein the piezoelectric layer includes zinc oxide.

Example 157 may include any one of Examples 126-154, wherein the piezoelectric layer includes lead zirconate titanate.

Example 158 may include any one of Examples 126-157, wherein the controller is a circuit.

Example 159 may include any one of Examples 126-158, wherein forming the diaphragm including the stressed region further includes: doping the stressed region with a structural dopant.

Example 160 may include Example 159, wherein the structural dopant is carbon.

Example 161 may include any one of Examples 126-158, wherein forming the diaphragm including the stressed region further includes: forming a pre-stressed layer over the diaphragm to impart the stressed region.

Example 162 may include Example 161, wherein the pre-stressed layer includes tungsten.

Example 163 may include any one of Examples 126-158, wherein forming the actuator over the diaphragm further includes: forming a pre-stressed layer of the actuator over a surface of the diaphragm to impart the stressed region.

Example 164 may include Example 163, wherein the pre-stressed layer of the actuator is at least one of the group of layers consisting of: a first electrode mechanically coupled to a top surface of the piezoelectric layer, the piezoelectric layer, and a second electrode mechanically coupled to a bottom surface of the piezoelectric layer over the diaphragm.

Example 165 may include any one of Examples 126-164, wherein forming the actuator over the diaphragm further includes: forming a second electrode over the diaphragm.

Example 166 may include Example 165, wherein the second electrode includes an electrically conductive material.

Example 167 may include Example 166, wherein the electrically conductive material is a metal.

Example 168 may include Example 167, wherein the metal includes at least one of the group consisting of: aluminum, gold, and platinum.

Example 169 may include Example 165, wherein forming the actuator over the diaphragm further includes: forming the piezoelectric layer over the diaphragm.

Example 170 may include Example 169, wherein the piezoelectric layer includes aluminum nitride.

Example 171 may include Example 169, wherein the piezoelectric layer includes zinc oxide.

Example 172 may include Example 169, wherein the piezoelectric layer includes lead zirconate titanate.

Example 173 may include Example 165, wherein forming the actuator over the diaphragm further includes: forming a first electrode over a top surface of the piezoelectric layer.

Example 174 may include Example 173, wherein the first electrode includes an electrically conductive material.

Example 175 may include Example 174, wherein the electrically conductive material is a metal.

Example 176 may include Example 175, wherein the metal includes at least one of the group consisting of: aluminum, gold, and platinum.

Example 177 may include any one of Examples 126-176, further including: coupling a sensor to the diaphragm configured to determine a position of the diaphragm between the two geometrically stable positions.

Example 178 may include Example 177, wherein coupling the sensor to the diaphragm further includes: forming a further piezoelectric layer over the diaphragm.

Example 179 may include Example 178, wherein the further piezoelectric layer includes aluminum nitride.

Example 180 may include Example 178, wherein the further piezoelectric layer includes zinc oxide.

Example 181 may include Example 178, wherein the further piezoelectric layer includes lead zirconate titanate.

Example 182 may include Example 177, wherein coupling the sensor to the diaphragm further includes: forming an electrode configured to capacitively couple to the diaphragm.

Example 183 may include Example 182, wherein the electrode includes an electrically conductive material.

Example 184 may include Example 183, wherein the electrically conductive material is a metal.

Example 185 may include Example 184, wherein the metal includes at least one of the group consisting of: aluminum, gold, and platinum.

In an aspect of the disclosure, Example 186 may be a method of operating a microelectromechanical device including: a substrate; a diaphragm mechanically coupled to the substrate, the diaphragm including a stressed region to buckle the diaphragm into one of two geometrically stable positions; an actuator mechanically coupled to the diaphragm, the actuator including a piezoelectric layer over the diaphragm; and a controller coupled to the actuator, the method including: receiving a digital sound input at the controller; and providing an electrical control signal to the actuator from the controller to exert a mechanical piezoelectric force on the diaphragm via the piezoelectric layer to move the diaphragm to create a sound wave.

Example 187 may include Example 187, wherein the microelectromechanical device further includes a sensor coupled to the diaphragm, wherein the method further includes: determining a position of the diaphragm via the sensor between the two geometrically stable positions.

Example 188 may include Example 187, further including: determining a first position of the diaphragm via the sensor in one of the two geometrically stable positions and determining a second position of the diaphragm via the sensor in the other of the two geometrically stable positions.

Example 189 may include Example 188, wherein the microelectromechanical device further includes a memory coupled to the sensor, further including: comparing the first position and the second position determined via the sensor to a previously stored first position and second position in the memory to calibrate the microelectromechanical device.

Example 190 may include Example 188, wherein the microelectromechanical device further includes a memory coupled to the sensor, further including: comparing the first position and the second position determined via the sensor to a previously stored first position and second position in the memory to test the diaphragm for a stress-relaxation.

Example 191 may include any of Examples 186-190, wherein the mechanical piezoelectric force is a critical force that overcomes an equilibrium force maintaining the diaphragm in one of the two geometrically stable positions.

Example 192 may include any one of Examples 186-191, further including: controlling the actuator to exert a counter force against a movement of the diaphragm.

Example 193 may include Example 192, wherein the counter force decelerates the movement of the diaphragm.

Example 194 may include Example 192, wherein the counter force maintains a position of the diaphragm in an instable region between the two geometrically stable regions.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims, and all changes within the meaning and range of equivalency of the claims are therefore intended to be embraced.

What is claimed is:

1. A microelectromechanical device comprising:

a substrate;

a diaphragm mechanically coupled to the substrate, the diaphragm comprising a non-stressed region and a stressed region to buckle the diaphragm into one of two geometrically stable positions;

an actuator mechanically coupled to the diaphragm, the actuator comprising a piezoelectric layer over the diaphragm; and a controller configured to provide an electrical control signal in response to a digital sound input;

wherein the actuator is configured to receive the electrical control signal to exert a mechanical piezoelectric force on the diaphragm via the piezoelectric layer to move the diaphragm to create a sound wave.

2. The microelectromechanical device of claim 1, wherein the actuator is further configured to receive a further electrical control signal from the controller to control the diaphragm in a geometrically instable position between the two geometrically stable positions.

3. The microelectromechanical device of claim 2, wherein the actuator is further configured to control the diaphragm when moving.

4. The microelectromechanical device of claim 1, wherein the actuator is further configured to receive the electrical control signal to move the diaphragm from one geometrically stable position into the other geometrically stable position to create the sound wave.

5. The microelectromechanical device of claim 1, further comprising:

a sensor coupled to the diaphragm configured to determine a position of the diaphragm between the two geometrically stable positions.

6. The microelectromechanical device of claim 5, wherein the sensor comprises a further piezoelectric layer mechanically coupled to the diaphragm.

7. The microelectromechanical device of claim 5, wherein the sensor comprises an electrode capacitively coupled to the diaphragm.

8. The microelectromechanical device of claim 1, wherein the piezoelectric layer of the actuator is further configured as a sensor to determine a position of the diaphragm between the two geometrically stable positions.

9. The microelectromechanical device of claim 1, wherein the actuator further comprises a first electrode mechanically coupled to a top surface of the piezoelectric layer.

10. The microelectromechanical device of claim 9, wherein the actuator further comprises a second electrode mechanically coupled to a bottom surface of the piezoelectric layer over the diaphragm.

11. The microelectromechanical device of claim 9, wherein the diaphragm further comprises a conductive region configured as a second electrode mechanically coupled to a bottom surface of the piezoelectric layer.

12. The microelectromechanical device of claim 1, wherein the stressed region of the diaphragm comprises a structural dopant.

13. The microelectromechanical device of claim 1, wherein the diaphragm further comprises a pre-stressed layer mechanically coupled to a surface of the diaphragm to impart the stressed region.

14. The microelectromechanical device of claim 1, wherein the actuator comprises a pre-stressed layer mechanically coupled over a surface of the diaphragm to impart the stressed region.

15. The microelectromechanical device of claim 14, wherein the pre-stressed layer of the actuator is at least one of the group of layers consisting of:

a first electrode mechanically coupled to a top surface of the piezoelectric layer, the piezoelectric layer, and a second electrode mechanically coupled to a bottom surface of the piezoelectric layer over the diaphragm.

16. An array of microelectromechanical devices comprising:

a substrate;

a plurality of microelectromechanical devices according to claim 1 arranged on the substrate;

and an array controller coupled to the plurality of microelectromechanical devices configured to control the respective microelectromechanical devices with electrical control signals in accordance with the digital sound input to create an aggregate sound wave.

17. The array of claim 16, wherein the plurality of microelectromechanical devices comprises a plurality of groups of respective microelectromechanical devices;

wherein the array controller is further configured to control the respective groups of microelectromechanical devices with electrical control signals in accordance with the digital sound input to create the aggregate sound wave.

18. A method of manufacturing a microelectromechanical device comprising:

providing a substrate;

forming a diaphragm over the substrate, the diaphragm comprising a non-stressed region and a stressed region to buckle the diaphragm into one of two geometrically stable positions;

forming an actuator over the diaphragm, the actuator comprising a piezoelectric layer over the diaphragm; and coupling a controller to the actuator configured to provide an electrical control signal in response to a digital sound input;

wherein the actuator is configured to receive the electrical control signal to exert a mechanical piezoelectric force on the diaphragm via the piezoelectric layer to move the diaphragm to create a sound wave.

19. The method of manufacturing of claim 18, further comprising: coupling a sensor to the diaphragm configured to determine a position of the diaphragm between the two geometrically stable positions.

20. A method of operating a microelectromechanical device comprising: a substrate; a diaphragm mechanically coupled to the substrate, the diaphragm comprising a stressed region to buckle the diaphragm into one of two geometrically stable positions; an actuator mechanically coupled to the diaphragm, the actuator comprising a piezoelectric layer over the diaphragm; a sensor coupled to the diaphragm; a memory coupled to the sensor; and a controller coupled to the actuator, the method comprising:

receiving a digital sound input at the controller;

providing an electrical control signal to the actuator from the controller to exert a mechanical piezoelectric force on the diaphragm via the piezoelectric layer to move the diaphragm to create a sound wave;

determining a first position of the diaphragm via the sensor in one of the two geometrically stable positions;

determining a second position of the diaphragm via the sensor in the other of the two geometrically stable positions; and comparing the first position and the second position determined via the sensor to a previously stored first position and second position in the memory to calibrate the microelectromechanical device.

21. The method of operating the microelectromechanical device of claim 20, wherein the microelectromechanical device further comprises a sensor coupled to the diaphragm, wherein the method further comprises:

determining a position of the diaphragm via the sensor between the two geometrically stable positions.

22. A method of operating a microelectromechanical device comprising: a substrate; a diaphragm mechanically coupled to the substrate, the diaphragm comprising a stressed region to buckle the diaphragm into one of two geometrically stable positions; an actuator mechanically coupled to the diaphragm, the actuator comprising a piezoelectric layer over the diaphragm; a sensor coupled to the diaphragm; a memory coupled to the sensor; and a controller coupled to the actuator, the method comprising:

receiving a digital sound input at the controller;

providing an electrical control signal to the actuator from the controller to exert a mechanical piezoelectric force on the diaphragm via the piezoelectric layer to move the diaphragm to create a sound wave;

determining a first position of the diaphragm via the sensor in one of the two geometrically stable positions;

determining a second position of the diaphragm via the sensor in the other of the two geometrically stable positions; and comparing the first position and the second position determined via the sensor to a previously stored first position and second position in the memory to test the diaphragm for a stress-relaxation.

23. The microelectromechanical device of claim 1, wherein the stressed region is arranged laterally adjacent to the non-stressed region.

24. The method of manufacturing of claim 18, wherein the stressed region is arranged laterally adjacent to the non-stressed region.

* * * * *